US006729376B1

(12) United States Patent
Kakinuma et al.

(10) Patent No.: US 6,729,376 B1
(45) Date of Patent: May 4, 2004

(54) SHEET SORTING APPARATUS

(75) Inventors: Takeshi Kakinuma, Kyoto (JP); Akihiro Kamei, Kyoto (JP); Kazuhiko Hanaki, Kyoto (JP); Koichi Ohmae, Kyoto (JP); Norihito Ozeki, Kyoto (JP); Tetsunobu Shibata, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/095,365

(22) Filed: Jun. 10, 1998

(30) Foreign Application Priority Data

Jun. 19, 1997 (JP) ..... 9-177855
Sep. 2, 1997 (JP) ..... 9-251485
Dec. 18, 1997 (JP) ..... 9-363882

(51) Int. Cl.[7] ..... B32B 35/00

(52) U.S. Cl. ..... 156/521; 156/256; 156/270; 156/277; 156/358; 156/364; 156/566; 270/58.32; 399/381; 399/382; 399/405; 399/407

(58) Field of Search ..... 156/518

(56) References Cited

U.S. PATENT DOCUMENTS 3,245,859 A * 4/1966 Busk ..... 156/479
3,926,713 A * 12/1975 Lowe et al. ..... 156/510
4,070,220 A * 1/1978 Cavender ..... 156/227
4,966,644 A * 10/1990 Clark, Jr. et al. ..... 156/247
5,390,594 A * 2/1995 Nobile et al. ..... 101/92
5,556,492 A * 9/1996 Vonderhorst et al. ..... 156/64
5,807,457 A * 9/1998 Norman, Jr. et al. ..... 156/249

* cited by examiner

*Primary Examiner*—Linda L. Gray
(74) *Attorney, Agent, or Firm*—Morrison & Foerster LLP

(57) ABSTRACT

A sheet sorting apparatus which easily sorts sheets into groups, and makes these groups readily distinguishable on a single output tray. According to an aspect of the invention, there is provided a sheet sorting apparatus located at the sheet outlet location of an image processing device, the sheet sorting apparatus including a marker attaching mechanism for attaching markers at a certain position on the output sheets. The marker attaching mechanism includes a tape feeding device in which the tape has an adhesive surface along one side edge, a cutter for making a marker by cutting the tape at a preset length, guides for positioning the marker in the proper location on the output sheet, a marker attaching roller, and a feeder for feeding the sheet and marker together. The feeder presses the marker against the sheet to attach it. The advantages of the invention include the markers for separating the groups being attached to the sheets, so they will not fall out if the sheets are removed from the output tray. In addition, there is no pause in feeding the sheets to add markers between the groups, so there is no time loss in feeding the sheets to add markers between the groups.

13 Claims, 41 Drawing Sheets

TABLE 1

| DOCUMENT NO. | COLOR PATTERN | | | |
|---|---|---|---|---|
| NO. 1 | RED | – | – | – |
| NO. 2 | – | BLUE | – | – |
| NO. 3 | – | – | YELLOW | – |
| NO. 4 | – | – | – | GREEN |
| NO. 5 | RED | BLUE | – | – |
| ⋮ | | ⋮ | | |
| ⋮ | | ⋮ | | |

FIG.41

SHEET SORTING APPARATUS

FIELD OF THE INVENTION

The invention relates to a sheet feeding apparatus for an image processing device such as a printer, copier, or facsimile machine, and more particularly, to a sheet feeding apparatus that separates the sheets into groups.

RELATED ART

A conventional sheet sorting apparatus is located at the sheet output location of the sheet feeding apparatus. When the image processing device outputs sheets, the sheets are piled on a single tray, one by one. If the sheets in the tray make up a single group, and the group of sheets is removed before the next group is output, then there is no problem. However, if multiple groups of sheets are output to the tray, separate groups are not distinguishable.

Previous sheet sorting designs use several methods to distinguish the groups, such as adding an offset function or a ribbon inserting function. The offset function offsets the stack of sheets in each group in the tray. A disadvantage of this method is that the group divisions are easily lost when the sheets are removed from the tray.

The ribbon inserting function inserts a ribbon between each group of sheets. With this design, the sheet feeder must pause while the ribbon is placed on top of the last sheet in a group, and the sheets in the new group can only be output when the ribbon placement is finished. This adds to the total output time of the sheet feeder. Also, the ribbons can easily fall out of the stack of sheets when they are removed from the tray, and the separate groups are again lost.

Another previous design makes use of multiple trays, one for each group. This design leads to a large apparatus and high cost. Moreover, the use of multiple trays is not practical for a small device.

Despite the several developments in the art of separating the sheets into groups, there remains an opportunity to improve the sorting of sheets in an image processing device. In particular, there exists a need for a simple, small and inexpensive apparatus that easily sorts sheets into groups, and makes these groups readily distinguishable on a single output tray.

SUMMARY OF THE INVENTION

The main object of the invention is to provide an apparatus that easily sorts sheets into groups, and makes these groups readily distinguishable on a single output tray. The sheet sorting apparatus should be simple, small and inexpensive.

According to an aspect of the invention, there is provided a sheet sorting apparatus located at the sheet outlet location of an image processing device, the sheet sorting apparatus having marker attaching means for attaching markers at a certain position on the output sheets. The marker attaching means is comprised of a tape feeding mechanism in which the tape has an adhesive surface along one side edge, a cutter for the end of the tape to make a marker, guides to position the marker in the proper location on the output sheet, a marker attaching roller, and a feeder for feeding the sheet and marker together as one unit. The feeder presses the marker against the sheet to attach it. A special adhesive is used on the markers, so that a certain minimum amount of pressure is needed when a marker is adhered to a sheet. This pressure is provided by the feeder.

The image processing apparatus includes input devices such as scanners, OCR systems, copiers, and facsimile machines, which have image reading function, in addition to the output devices already mentioned which have image printing function.

An advantage of this invention is the markers for separating groups are attached to the sheets so that they won't fall out if the sheets are removed from the output tray. Another advantage is there is no pause in the feeding of the sheets to add markers between the groups, so there is no time-loss.

The above features and advantages of the invention will be better understood from the following detailed description taken into conjunction with the accompanying drawings.

BRIEF DESCRIPTION OF THE DRAWINGS

FIG. 41 is the table of color patterns in the second embodiment.

DETAILED DESCRIPTION OF THE PREFERRED EMBODIMENTS

Figure 1A:
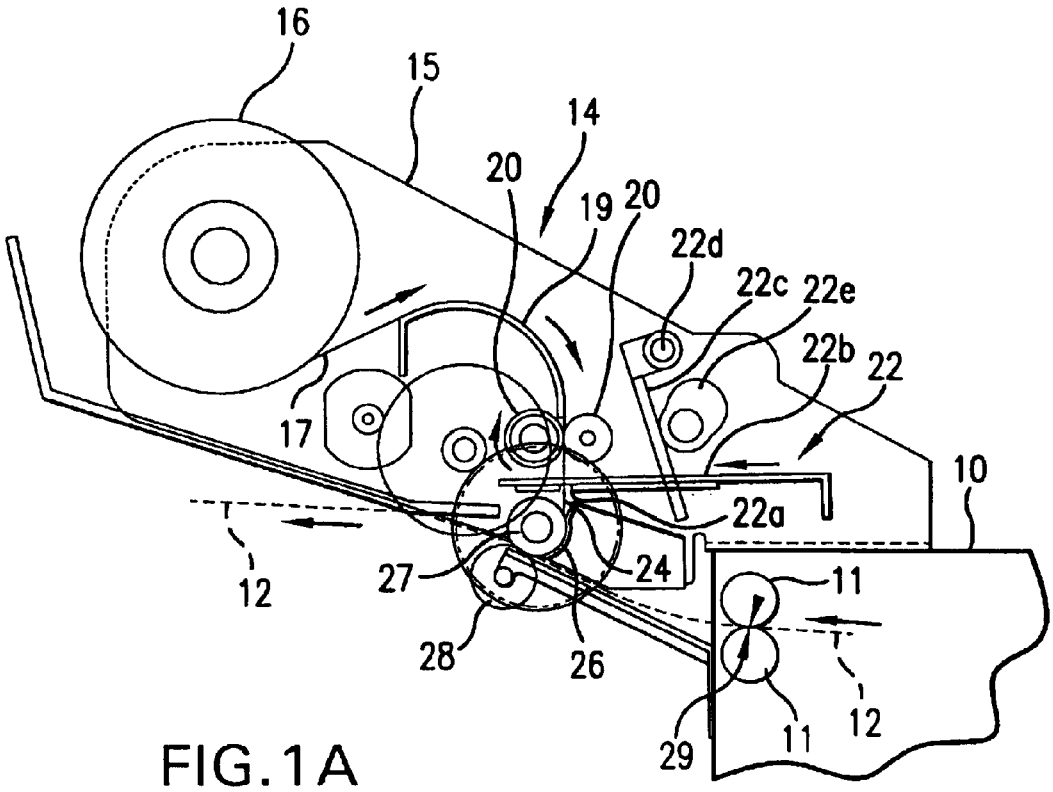
FIG. 1*a* is the first embodiment of a sheet sorting apparatus of the invention.

FIG. 1 is aside view of a first embodiment of the sheet sorting apparatus of the invention. A pair of exit rollers 11 are located near the outlet of an image processing apparatus 10 such as a printer. A sheet 12 is inserted in the rollers 11, receives feeding force from the rollers, and is ejected out of the apparatus. A receiving tray (not shown) is located beneath the outlet and the ejected sheet 12 falls into the tray. After all sheets are ejected, the group of sheets piled in the tray is picked up.

A sorting machine 14 of the invention is located at the outlet of the image processing apparatus 10. A marker is attached on sheets by the sorting apparatus. Groups of sheets are divided by the markers so that the groups can be distinguished from one another. An advantage of the invention is the markers are attached without pausing the output of the sheets.

Figure 1B:
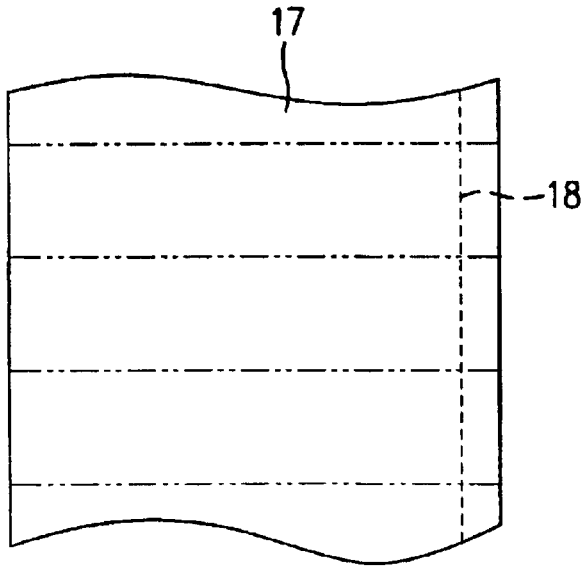
FIG. 1*b* is a part of the uncut marker tape.
Figure 2:
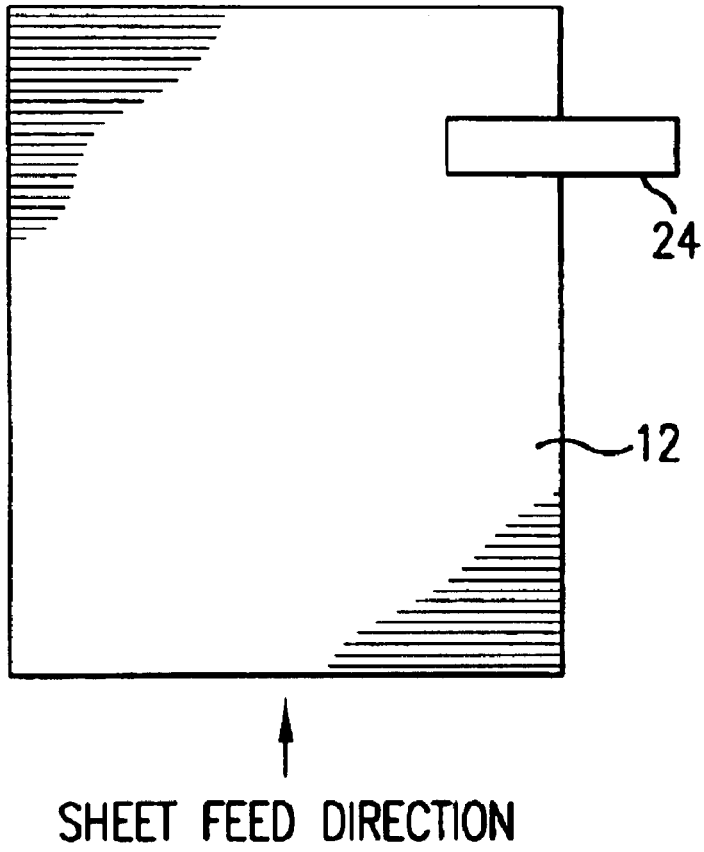
FIG. 2 is a diagram illustrating how a marker is positioned on a sheet.

In this embodiment, a tape roll 16 is mounted in a housing 15. The tape roll is wound with paper tape 17. The tape is pulled out continuously and fed along a feeding path 19. The tape, as shown in FIG. 1*b*, has adhesive 18 applied along an edge of one side of the tape. The adhesive is pressure sensitive and does not adhere to a surface until a certain minimum pressure is applied. The adhesive should be non-permanent and easily detachable, like the adhesive used on sticky memo pads.

At the lower end of the feeding path 19 are a pair of pull-out rollers 20. The tape 17 is sandwiched by these rollers and pulled out. The surface of one of the rollers 20 has a smaller diameter at one end to avoid placing pressure on the adhesive.

A cutter apparatus 22 is located below the rollers 20. A marker 24 is formed by cutting the tape at a preset length. As shown in FIG. 1*b*, all markers have the same size, but the size can be adjusted.

The cutter apparatus 22 includes a lever 22*c* connected to a holder 22*b* of a cutter edge 22*a*. The upper end of the lever 22*c* is connected to a rotation axis 22*d*. The lever swings bidirectionally with a predetermined degree of rotation. The middle of the lever contacts an eccentric cam 22*e*. When the eccentric cam 22*e* rotates, the lever 22*c* is moved along with the cutter holder 22*b* causing the cutter edge 22*a* to move back and forth. The tape 17 is cut by the cutter edge, forming the marker 24.

After being cut, the marker 24 is guided to the attaching position by a guide 26. The edge area of the sheet 12 is determined by pressure roller 27. The sheet and marker are then sandwiched by the pressure roller 27 and roller 28, and pressed by a predetermined pressure. This pressure causes the marker to adhere to the sheet. In this process, the rotation velocity of the pressure roller 27 and exit rollers 11 is the same. Another advantage of the invention is the marker 24 is attached to sheet 12 without pausing the ejection operation of the sheets.

In this embodiment the pull-out roller 20, eccentric cam 22*e*, and pressure roller 27 are all connected to the same drive motor (not shown). They are driven at a preset intermittent and timing rate.

Figure 3A:
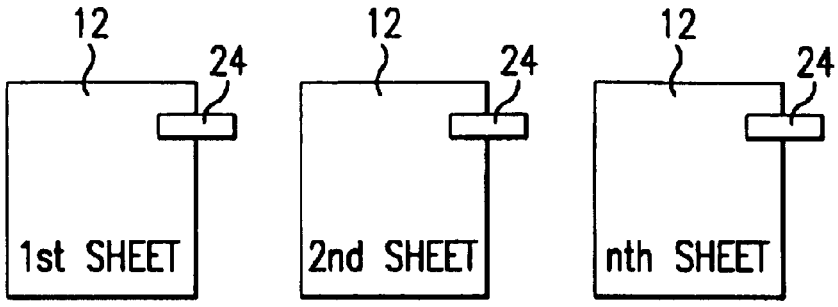
FIGS. 3*a* and 3*b* show markers adhered at similar or different locations on a series of sheets.

A sheet detection sensor 29 is located near the exit rollers 11. The sensor detects the front edge of a sheet 12 and gives a signal. On receiving the signal, the pull-out rollers 20 rotate and the tape 17 is pulled out to a preset length after a predetermined time. The cutter edge 22*a* then cuts the tape 17 to make a marker 24. The marker may be attached at the same position on each sheet as shown in FIG. 3*a*, or at different positions as in FIG. 3*b* by changing the time to start the cutting of the cutter apparatus 22. The sensor 29 may be located near the inlet of the sorting apparatus 14 rather than at the exit rollers 11.

Figure 3B:
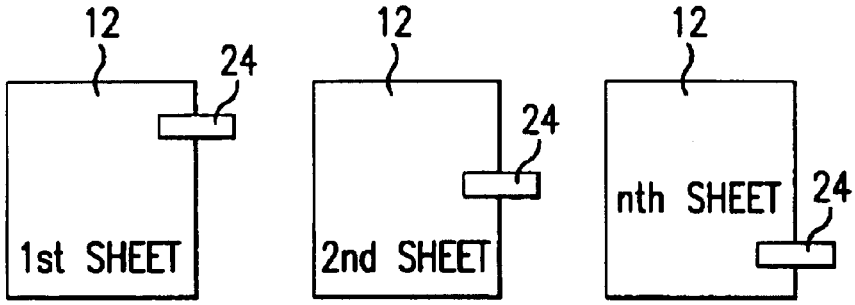

In using the sorting apparatus, a marker may be attached on each sheet or attached once after every predetermined number of sheets (such as every fifth sheet) or every group of documents. When the attaching position varies as shown in FIG. 3*b*, the same groups may have markers at the same position on each sheet. This way if many groups are stacked on a single tray, all the members of any one group can be easily distinguished.

Figure 4:
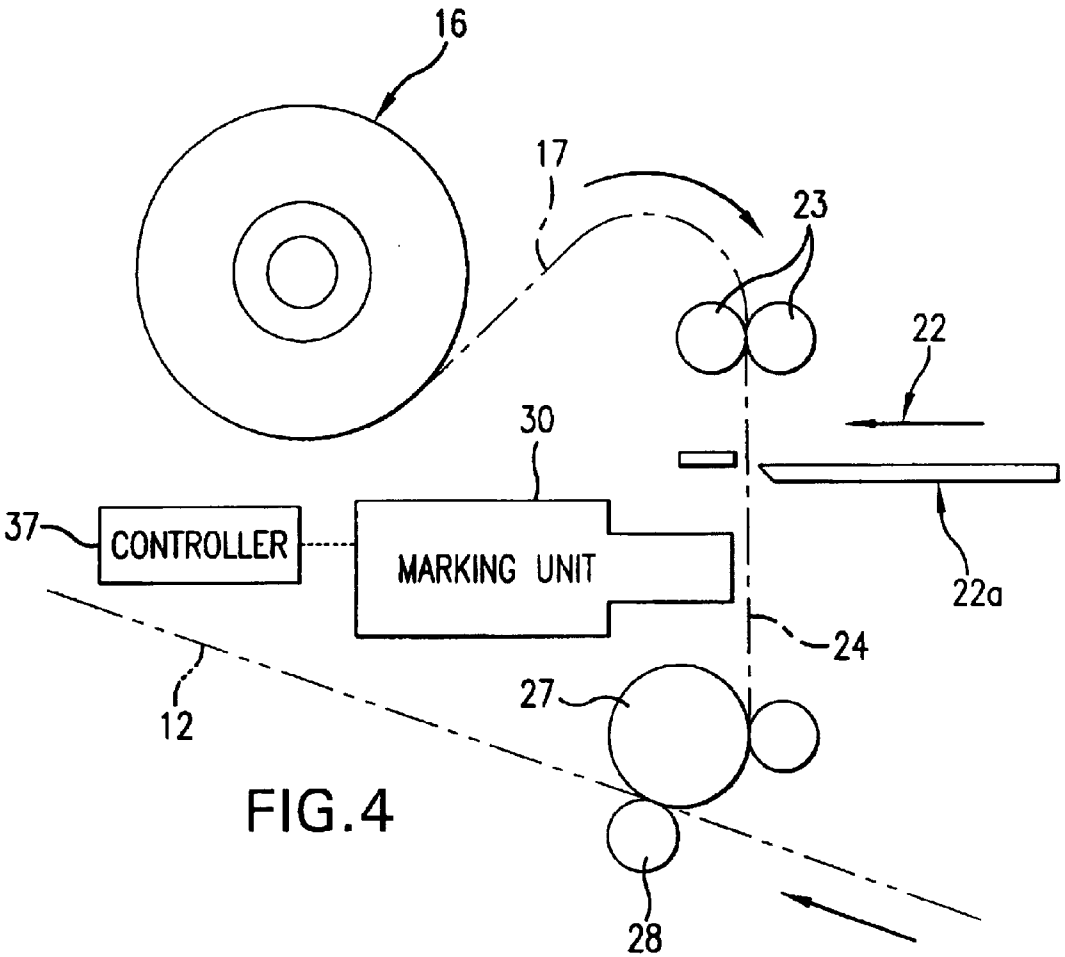
FIG. 4 is a simplified view of the second embodiment of a sheet sorting apparatus of the invention.

FIG. 4 shows a second embodiment of a sheet sorting apparatus of the invention. This embodiment is similar to the first embodiment, and the same reference numbers are used to denote parts that are unchanged from the previous description. In this embodiment there is a marking unit 30 located below the cutter apparatus 22.

The marking unit 30 applies color to the marker 24. In this embodiment, for example, red, blue, yellow, and green colors can be applied to markers. An ink jet unit can be applied as the marking unit. The nozzles are controlled by a controller 37, to give any required color. Any ink can be used as a replacement supply. The controller 37 causes the same color to be printed-on each marker 24 that is attached to the same group of sheets based on the control of the image processing apparatus 10. Thus, different groups of sheets may be printed with different color patterns.

Figure 5:
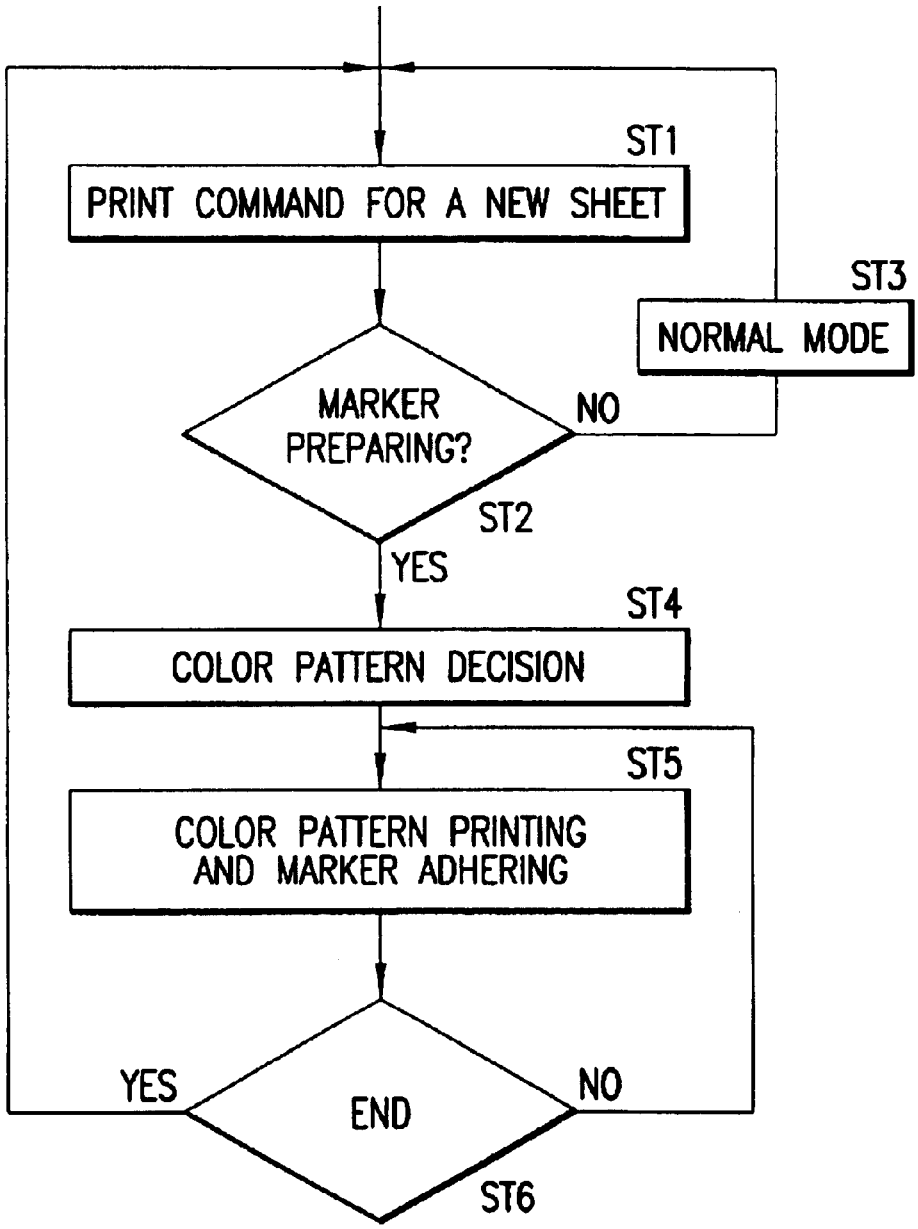
FIG. 5 is a flow chart showing the operation of the color marking unit controller in the second embodiment.

The operation of the controller 37 is shown in FIG. 5. The print command for a new sheet is applied by the controller (ST1). The controller determines if the sorting and printing operations should happen simultaneously, that is, whether or not to prepare a marker (ST2). When it is unnecessary to adhere a marker to the next sheet, the inkjet does not operate (ST3). If the controller determines it is necessary to adhere a marker to the coming sheet, it then decides on the color to be printed on the marker (ST4). If the color will be the same as the previous color that was printed, then no action is necessary. Otherwise the color is changed to the color for the new group.

A color pattern table is shown in TABLE 1 of FIG. 41. The controller 37 sets the color order from the table. The marking unit 30 prints the selected color pattern on the marker 24 during printing of the same group of sheets. The printed marker is attached to the sheet, and therefore all group members have the same color (ST5). After all printing operations are carried out for the sheet, the apparatus prepares for the next operation (ST6).

Figure 6:
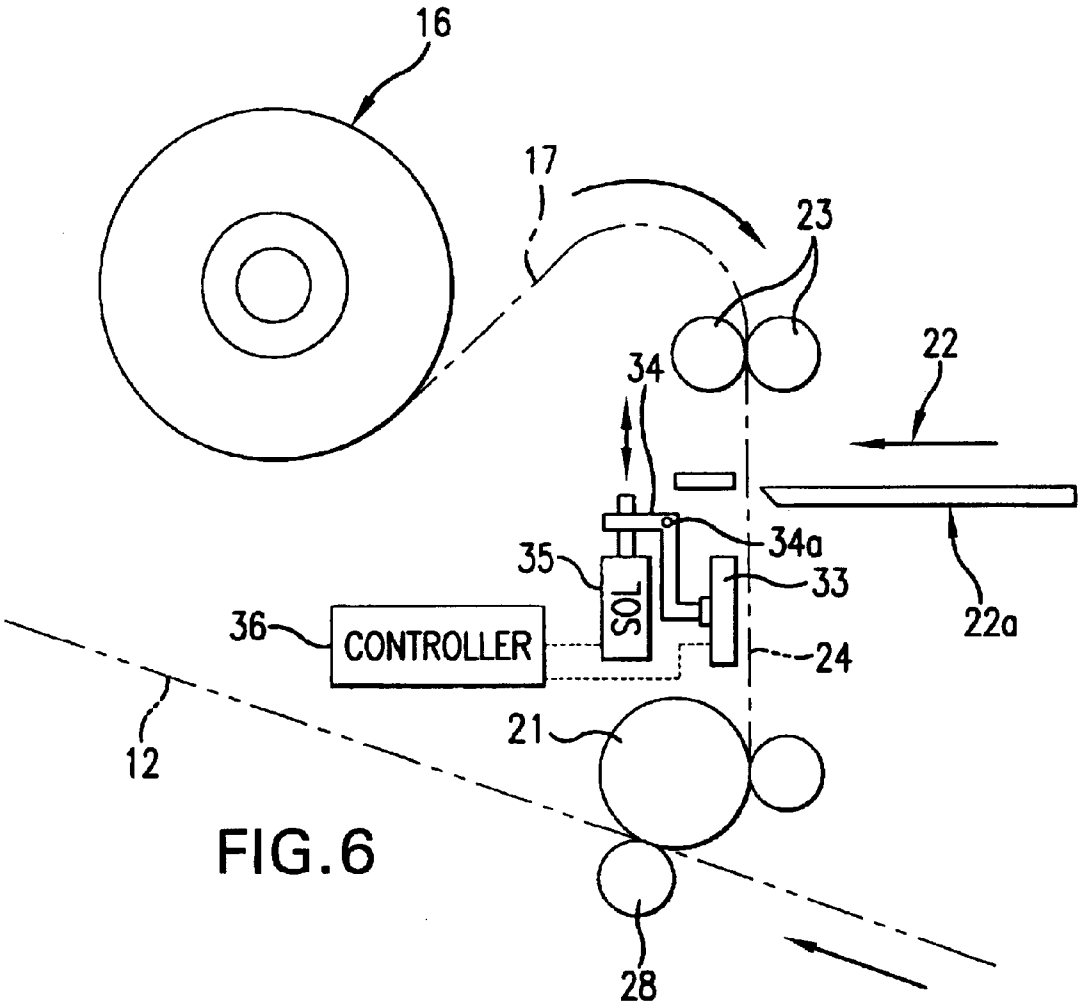
FIG. 6 is a simplified view of the third embodiment of a sheet sorting apparatus of the invention.
Figure 7A:
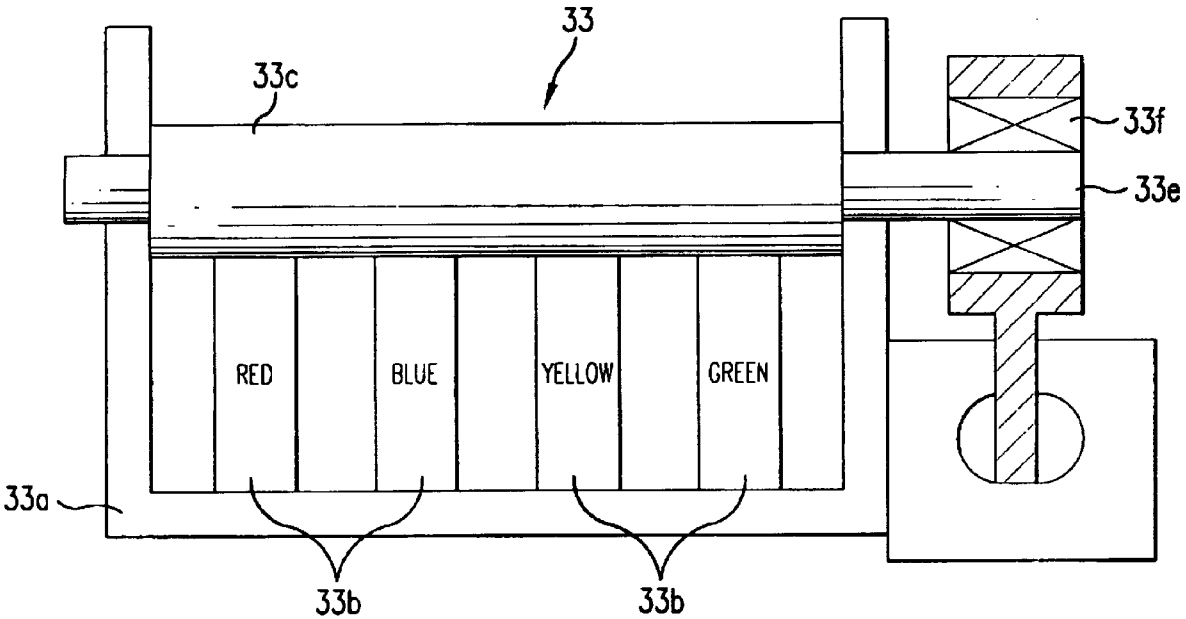
FIG. 7*a* shows the inner structure of a stamper unit.
Figure 7C:
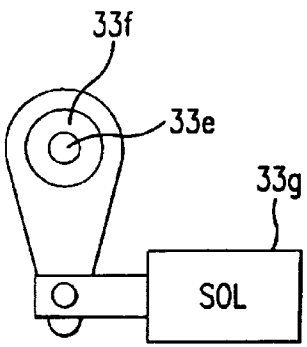
FIG. 7*b* shows a color pattern selecting cam and FIG. 7*c* shows a solenoid for controlling the rotation of the color pattern selecting cam.
Figure 7B:
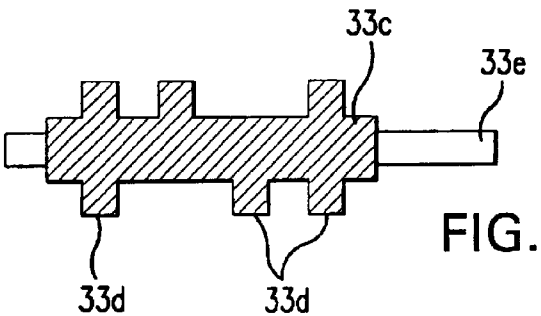

FIG. 6 shows the third embodiment of the sheet sorting apparatus of the invention. In this embodiment, a color pattern is printed by a stamper. In the second embodiment the inkjet printer was used, but in the third embodiment a stamper is used instead. A stamper unit 33 is connected to a solenoid 35 through a link mechanism 34. The link mechanism rotates around a pivot 34*a*, in both clockwise and counterclockwise directions. The solenoid 35 moves up and down, and the stamper moves back and forth accordingly. The inner structure of the stamper 33 is shown in. FIG. 7*a*. There are four stamps 33*b* (red, blue, yellow, and green) in the casing 33*a* arranged in a row. The stamps 33*b* are changeable by cartridges. One or more of the four stamps 33*b* is selected to stamp a colored pattern on the marker. The color pattern changing mechanism has a color pattern selecting cam 33*c*. This color pattern selecting cam 33*c* is shown in FIG. 7*b*. The cam has projections 33*d* around the surface along the shaft 33*e*. The projections 33*d* contact the stamps 33*b* and push downward. For example, in FIG. 7*b* red, yellow, and green patterns are printed. The projection number and patterns are different. By rotating the cam, the pattern of the projections is changed, and the printed color pattern is changed. Rotation of cam 33*c* is controlled by solenoid 33*g* as shown in FIG. 7*c*. A one-way latch 33*f* is connected to the solenoid 33*g*. When the solenoid moves a predetermined length, the latch rotates the axis, but if the latch moves in the opposite direction the latch does not rotate.

The solenoid 33*g* as well as the solenoid 35 are driven and controlled by the controller 36. The controller 36 operates similarly to the second embodiment, as shown in FIG. 5. For example, in FIG. 5 when the color pattern is decided in Step 4, the chosen pattern is set to print by solenoid 33*g*, and the color pattern is printed in Step 5. The color pattern is decided at the same time as the operation of the tape 17 and cutting apparatus 22. When the tape 17 is pulled out to a preset length, the end of the tape reaches the roller 21, the solenoid works to stamp the tape, and the cutter moves forward to cut the tape.

In the second and third embodiments, multiple color patterns are prepared to print the different color patterns in order to distinguish the different groups of sheets. In this invention the plural patterns are not limited to color patterns. Characters may also be printed instead of color patterns;

Although a certain pattern is printed on the marker in the second and third embodiments, the pattern may also be printed directly on the sheet.

Figure 8:
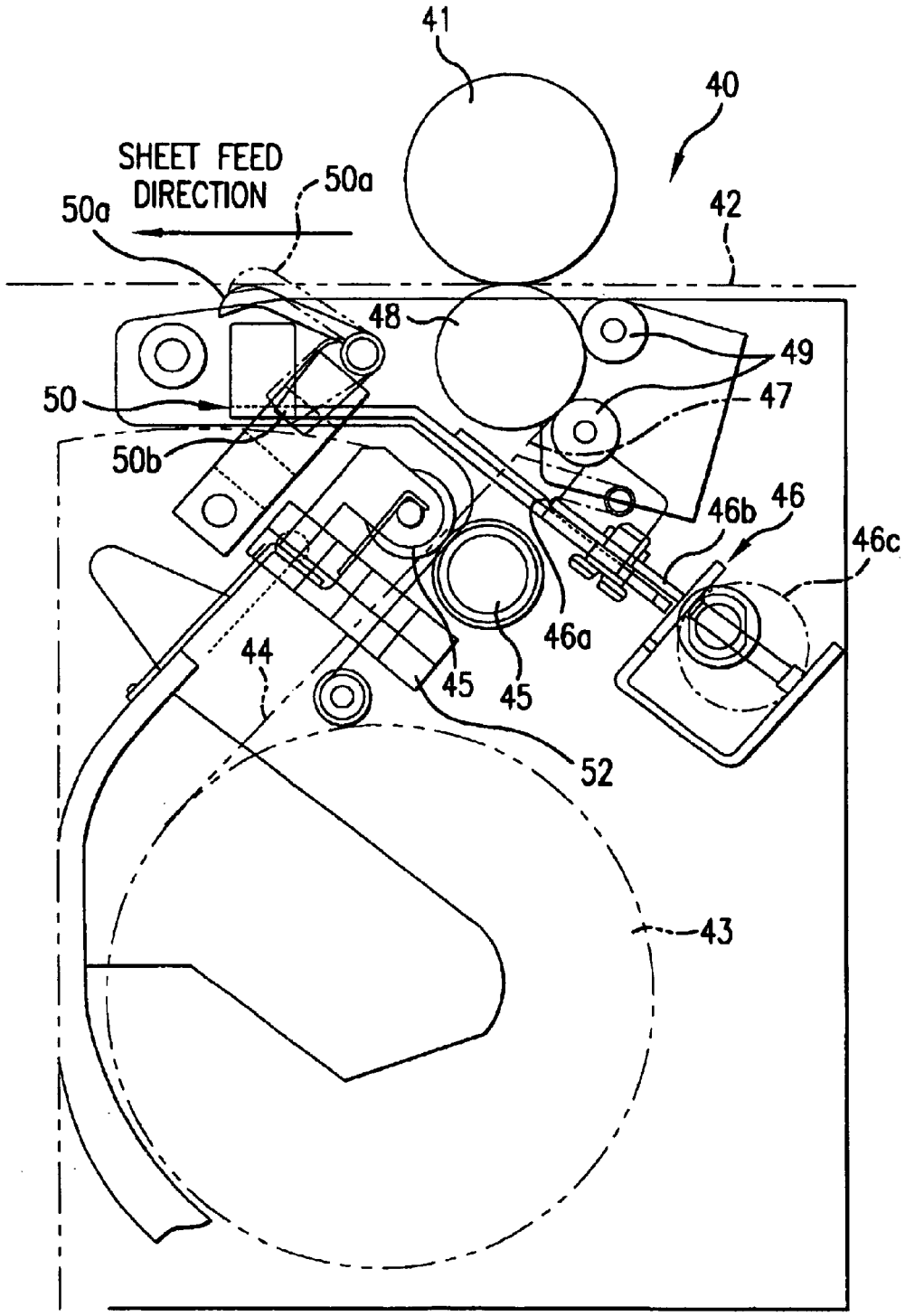
FIG. 8 is the fourth embodiment of a sheet sorting apparatus of the invention.

FIG. 8 shows the fourth embodiment of the sheet sorting apparatus of the invention. In this embodiment, the marker is attached to the underside of the sheet. In this way, the next sheet added to the output tray will not separate the marker from the sheet. The sheet sorting apparatus 40 is located on the outlet of the image processing apparatus. The sheet sorting apparatus is attached under the output roller 41. Paper tape 44 is fed continuously from tape roll 43. A roller 45 pulls the tape. Each side of the tape has adhesive material. A cutting apparatus 46 is located near the roller 45, and the cutting apparatus creates marker 47 by cutting the end of the tape 44.

In FIG. 8, a cutter holder 46*b* is connected to an eccentric cam 46*c*. The cutter holder 46*b* has a cutter edge 46*a* on the top end. By the rotation of the eccentric cam, the cutter holder is moved back and forth. The cutter edge cuts the tape 44. A marker attachment roller 48 and marker pinch rollers 49 guide the marker 47. The attachment roller 48 contacts the sheet output roller 41, and the marker is attached to the sheet 42 as both of them pass through the rollers. In this case the marker is affixed to the underside of the sheet. The marker 47 is supported by rollers 48 and 49. This operation is shown in FIGS. 9 and 10.

Preferably, the rotation velocity of the attachment roller 48 is equal to the feeding velocity of the sheet 42. If the rotation velocity of the roller differs from the feeding speed of the sheet, then the sheet could jam or become skewed. For the synchronous operation of the rollers 48 and 49, each roller has a gear and these gears are interlocking. The driving force for the rollers 49 is provide by the feeding roller 41.

Figure 11:
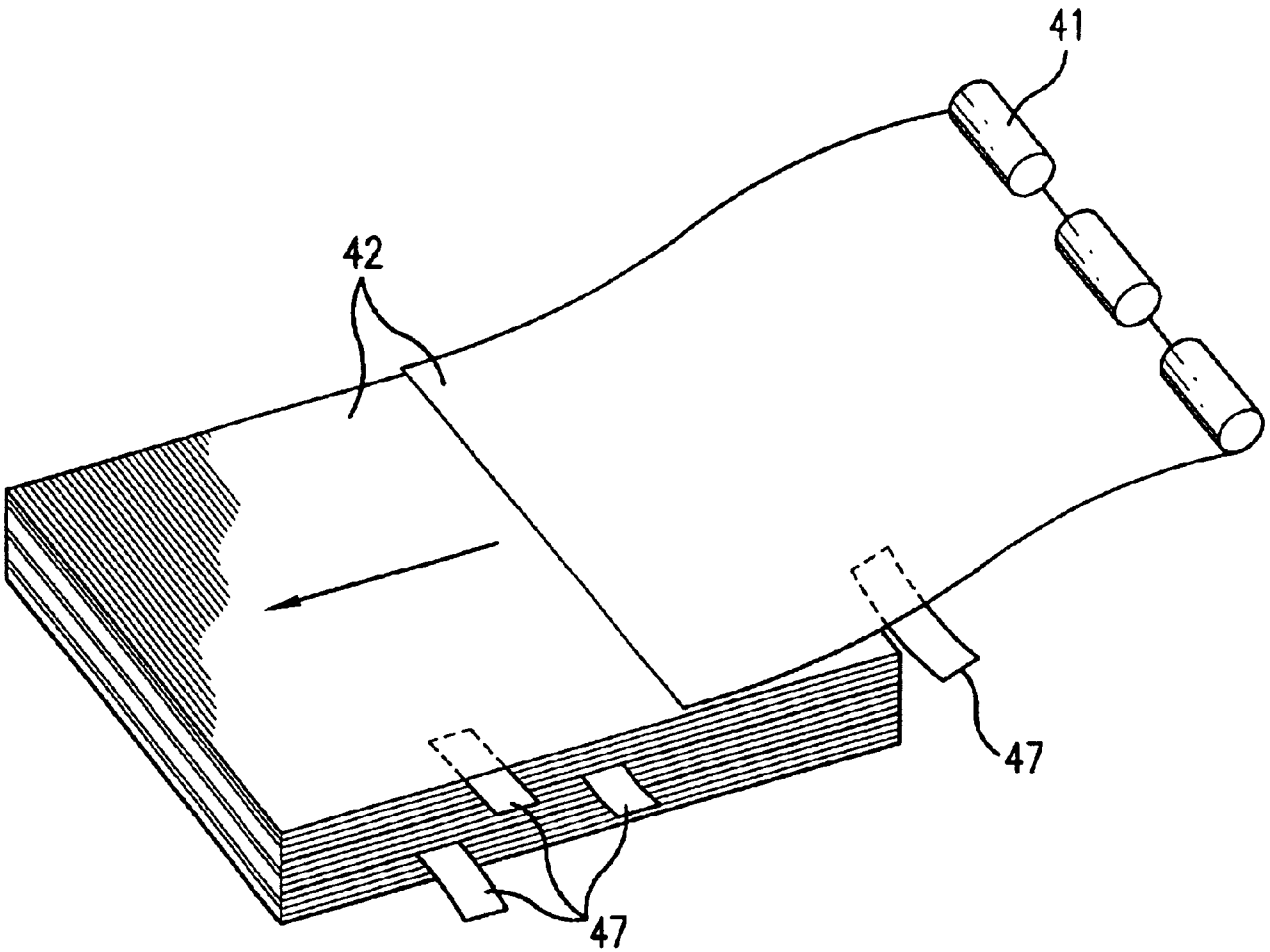
FIG. 11 illustrates how the sheets are sorted on the output tray by the fourth embodiment.

In this embodiment, as described in the first embodiment, the time delay from sheet detection to the start of rotation is adjustable. By changing the delay time, the position where the marker 47 is adhered to the sheet changes as shown in FIG. 11. Of course, as in the second and third embodiments, a color or other printed pattern may be printed on the marker 47. Referring to FIG. 8, a marker detecting apparatus 50 is positioned on the sheet feeding path after the attachment roller 48. The detecting apparatus 50 detects if the marker is or is not in the correct position on the sheet. The detecting apparatus has an L-shaped lever 50*a* and a switch 50*b*. The switch is turned on or off by the position of the lever 50*a*. The lever rotates around the axis located at the center bent section.

Figure 10:
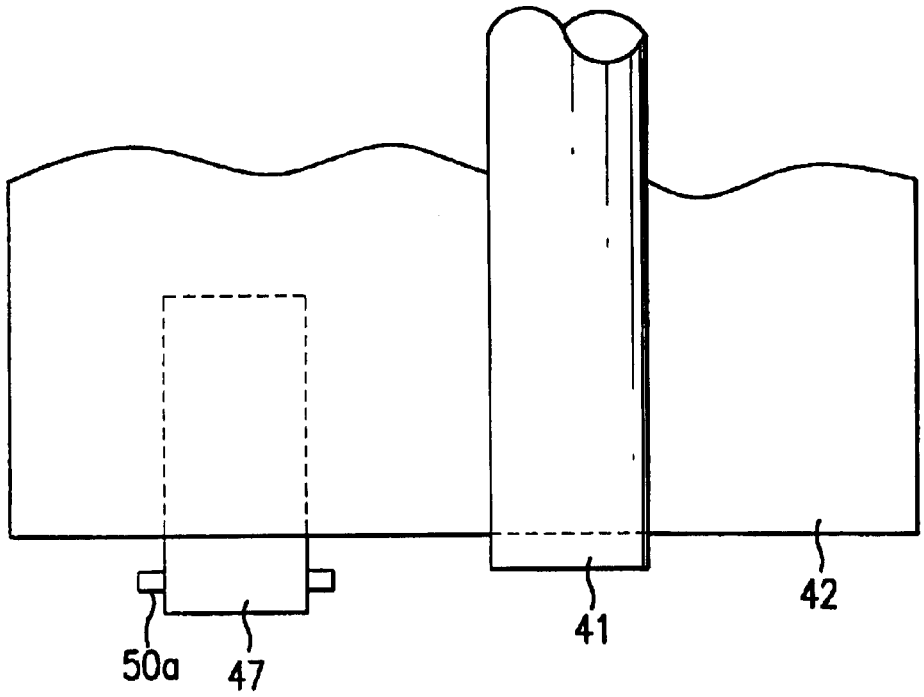
FIG. 10 is a simplified top view of the fourth embodiment.

Turning to FIG. 10, the lever 50*a* is located beside the sheet feeding path where it can contact the marker 47. When there is no feeding sheet, the end of the lever 50*a* crosses the sheet feeding plane by a spring operation as shown by the dotted line in FIG. 8. When a marker 47 contacts the lever 50*a*, the lever is moved downward. By the movement of the lower end of the lever 50*a*, the switch 50*b* is turned on. Various types of switches can be used. For example, a micro-contact switch or a non-contact switch such as a proximity sensor can be used.

Whether or not the marker 47 will adhere at a predetermined position correctly or not is detected by the signal of the switch 50*b*. If the marker adhering operation is done and the switch 50*b* is off, then the controller judges that the adhering operation was done correctly. If a signal of incorrect attachment is received, then a predetermined alarm output is generated, such as a flashing lamp.

Figure 9A:
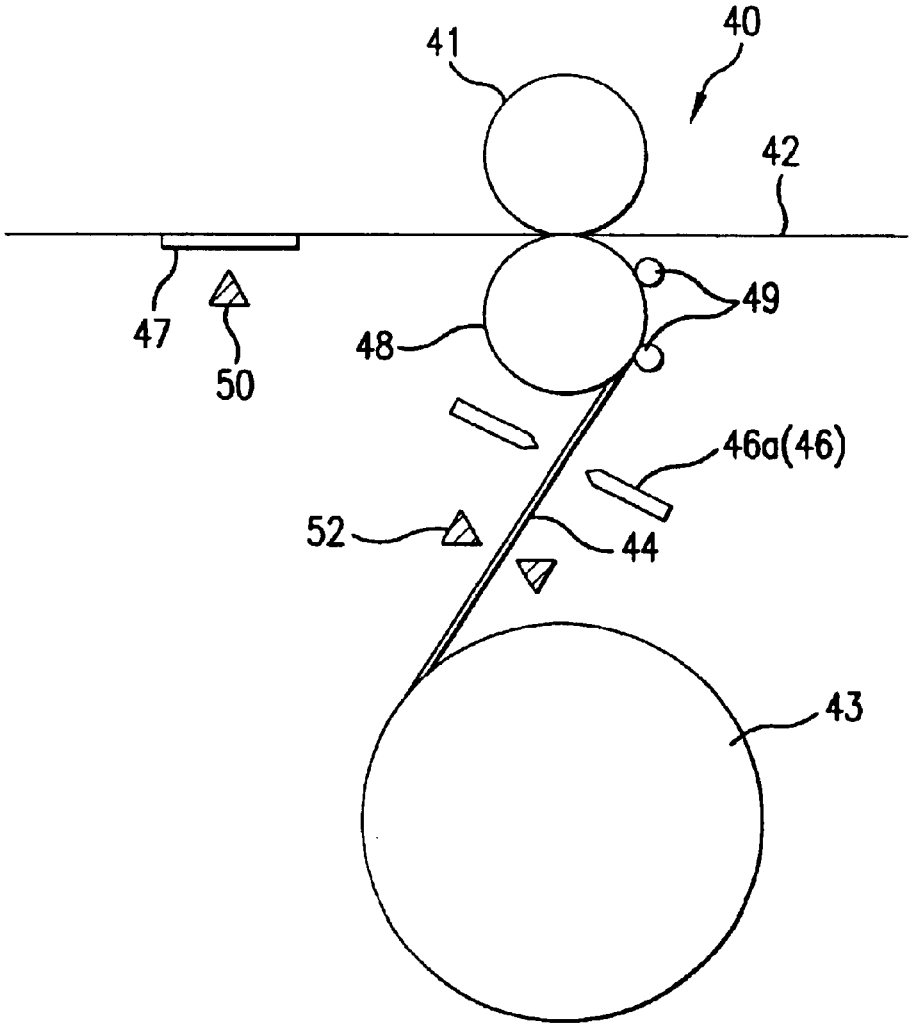
FIG. 9*a* is a simplified view of the fourth embodiment.
Figure 9B:
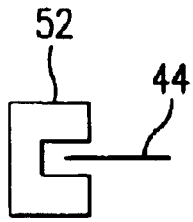
FIG. 9*b* shows the tape detection sensor of the fourth embodiment.

Referring to FIG. 9*a*, a sensor 52 to detect an out-of-tape condition is located on the lower position of cutter apparatus 46. The sensor 52 may be a photo-electric or other type of sensor. In this embodiment, the sensor 52 is a transparent type photo-electric sensor. When there is tape 44 in front of the sensor 52, light to the sensor is blocked. When there is no tape, light is detected. When the end of the tape passes beyond the sensor, a tape empty signal is generated. Based on the signal, an out-of-tape message is sent.

FIG. 12 shows the fifth embodiment of the sheet sorting apparatus of the invention. This embodiment is based on the fourth embodiment. Additionally, the attachment roller 48 is movable up and down to separate the roller from the feed roller 41. In this embodiment, when the attachment of the marker is not needed, the attachment roller is separated from the feeding roller, so the sheet 42 is not pressed with unnecessary force.

Figure 12A:
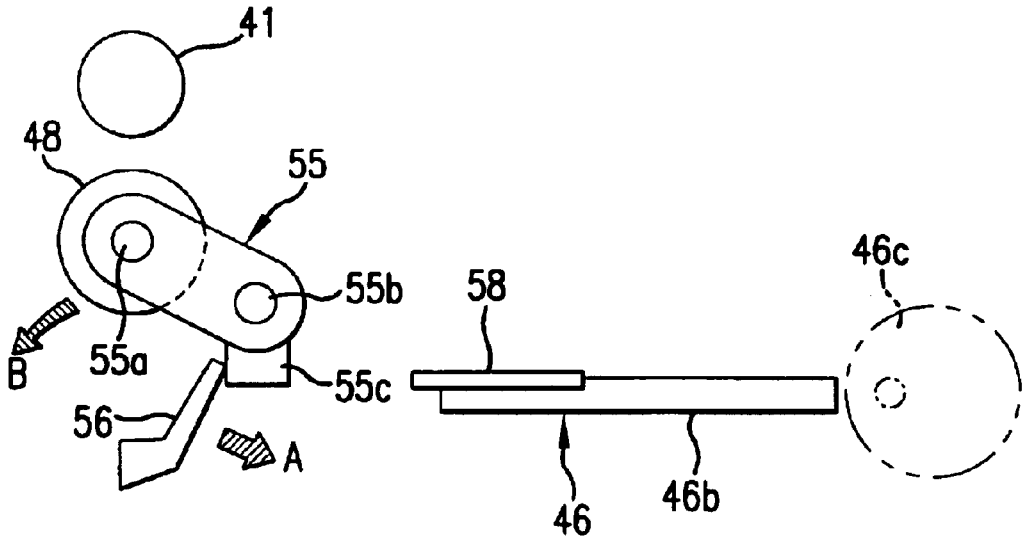
FIGS. 12*a* and 12*b* are simplified views of the fifth embodiment of a sheet sorting apparatus of the invention.
Figure 12B:
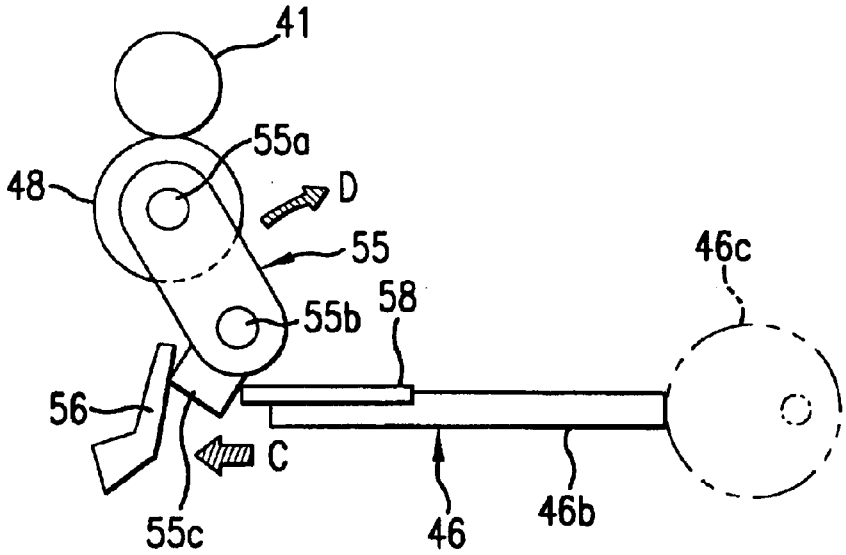

In this embodiment, the cutter apparatus 46 and attachment roller 48 operate synchronously. The attachment roller is held on the upper end of a link arm 55, which rotates around the axis 55*b*. On the lower end 55*c* of the lever, a torsion spring 56 provides force in the A direction, as indicated in FIG. 12*a*. By the force of the torsion spring, the link arm moves in the B direction and separates the attachment roller 48 from the feeding roller 41. The sheet 42 is then fed smoothly by roller 41 only. A pressure lever 58 is provided on the end of the cutter holder 46*b*. When the cutter holder moves to cut the tape, the pressure lever 58 moves as well. The end of the pressure lever contacts the lower end of the link arm 55, forcing the link arm to move in the C direction. By this force, the torsion spring 56 is deformed. The link arm rotates in the D direction as shown in FIG. 12*b*, and the attachment roller 48 contacts the feeding roller 41. In this position, the marker can be adhered to the sheet. When the rotation force of the attachment roller 48 is applied to the feed roller 41, the operation is the same as explained in the fourth embodiment.

Gears are not shown, but roller 48 is only driven when the gears on the same axis contact gears on the axis of feed roller 41. In the fifth embodiment, unnecessary force by the feed rollers is eliminated. When the cutter apparatus 46 cuts the tape, eccentric cam 46*c* is positioned as shown in FIG. 12*b*. After a set amount of time, the marker is adhered to the sheet. Then the eccentric cam 46*c* returns to its normal position as shown in FIG. 12*a*.

The mechanism for movement of the attachment roller 48 is not limited to this embodiment. The movement mechanism and driving mechanism may also be provided independently. The independent mechanism can be operated by a control signal to adhere the marker.

Figure 13:
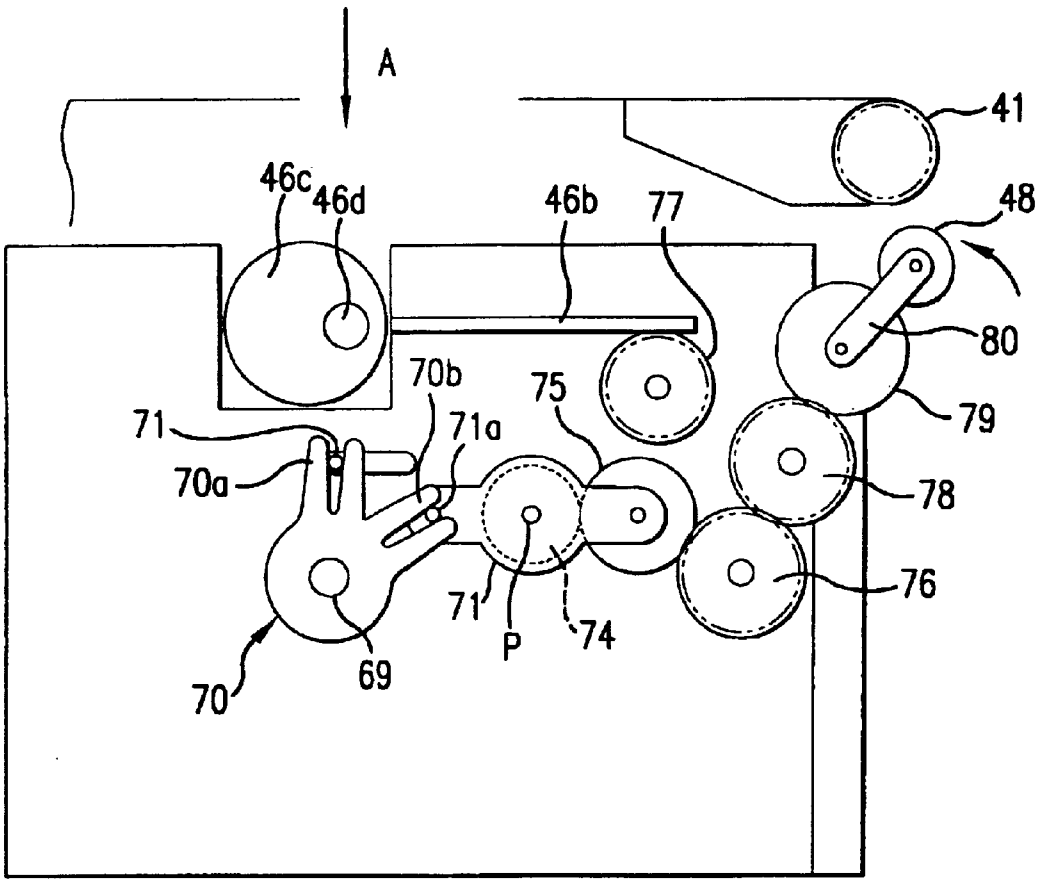
FIG. 13 is an external view of the sixth embodiment of a sheet sorting apparatus of the invention.
Figure 14:
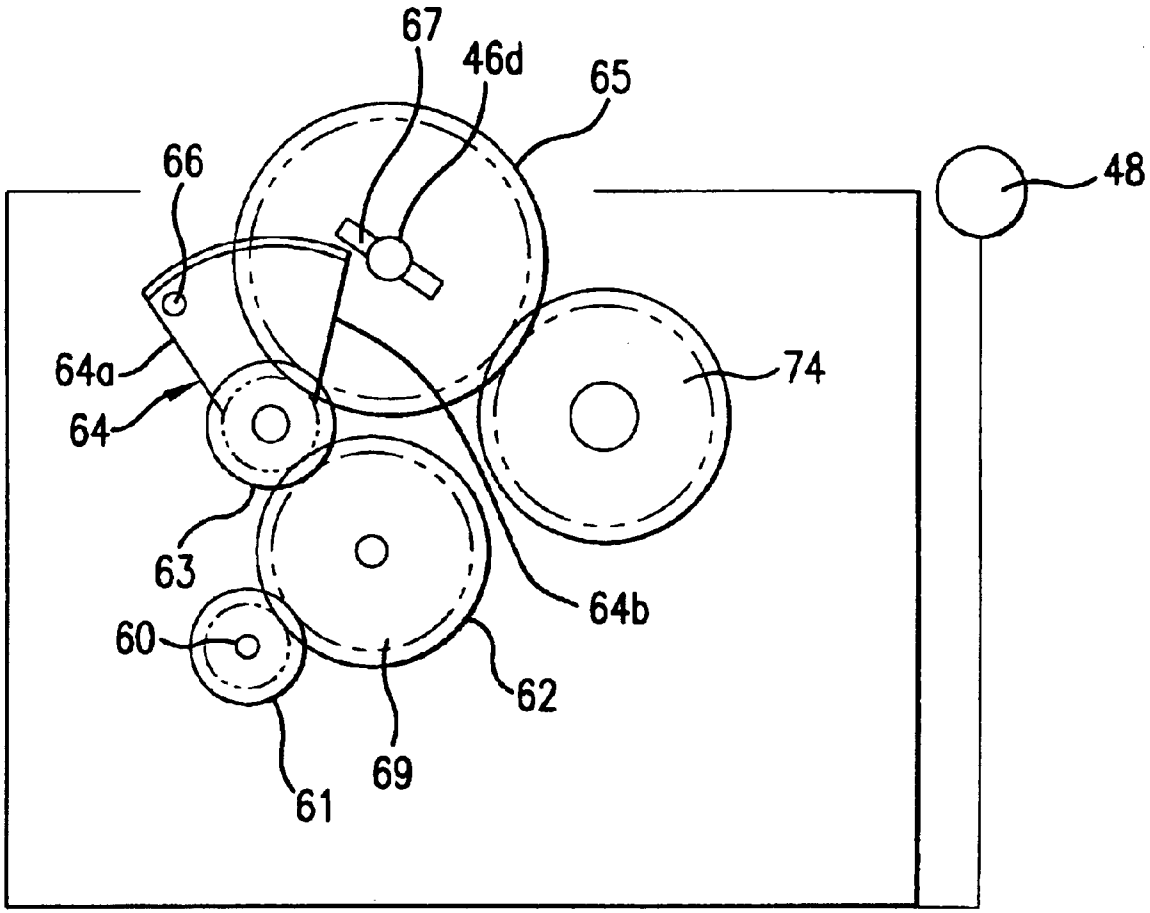
FIG. 14 is an internal view of the sixth embodiment.
Figure 15:
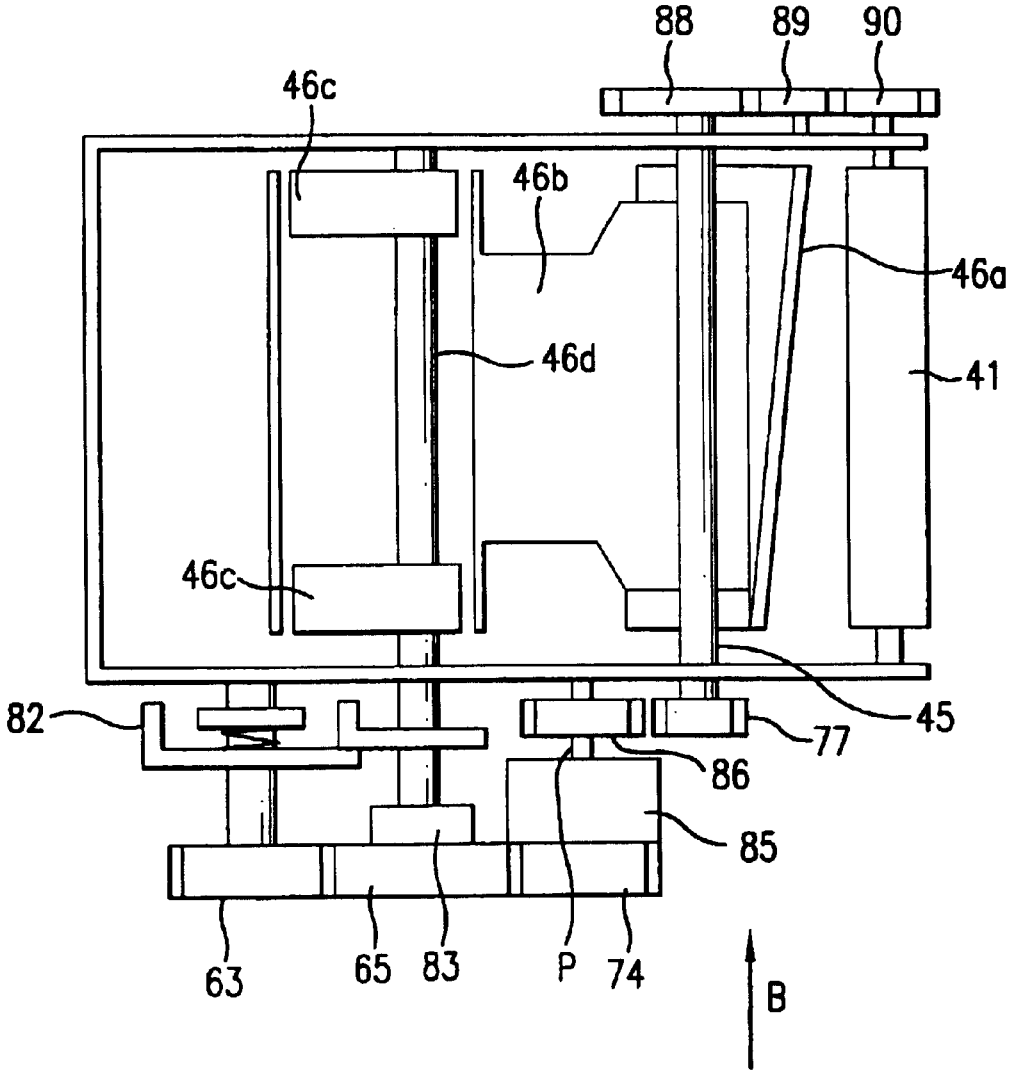
FIG. 15 is a top view of the sixth embodiment.

The sixth embodiment of the sheet sorting apparatus of the invention will now be described. The standard position for feeding the sheet in the sixth embodiment is shown in FIGS. 13–15. FIG. 13 is the view from the B direction in FIG. 15, and FIG. 15 is the top view. FIG. 14 shows the inner structure of the apparatus. This embodiment is based on the fifth embodiment. In this sixth embodiment, in order to simplify the structure, movement of the cutter apparatus 46, pulling of the tape 44, and feeding and attaching the marker 47 are driven by a single motor.

In this embodiment, as in the fifth embodiment, a cutter apparatus 46 is moved by an eccentric cam 46*c*. The cutter edge 46*a* cuts the tape. In FIG. 15, the cutter edge is angled. By this configuration, the cutter cuts the tape sharply and surely. As described in the previous embodiment, the attachment roller 48 only contacts the sheet when the marker is to be adhered.

In the drive system, a driving motor capable of alternating rotation, such as a servo motor, is used. First gear 61 is located on the output shaft 60 of the driving motor. Second gear 62 contacts first gear 61. The first gear 61 rotates counterclockwise. In this embodiment, forward rotation is defined as counterclockwise rotation of the first gear 61, and reverse rotation is clockwise rotation of it. Third gear 63 contacts second gear 62. A stopper 64 is attached to gear 63. The stopper 64 has a hollow wedge shape. When the driving motor alternates rotation, the stopper 64 moves back and forth around the axis of the third gear 63. A fixed rod 66 passes through the interior of the stopper 64 to limit the stopper's movement. A torque limiter 82 is provided on the shaft of the third gear 63. When torque greater than a set value is applied to the shaft, the shaft is blocked by the limiter. In this way, if the driving motor rotates beyond the movement limit of the stopper, then the stopper will not rotate further. By this mechanism, rotation control of the driving motor can be rough, but the stopper is positioned precisely.

A fourth gear 65 is provided on the end of the shaft 46*d* of the eccentric cam 46*c*. A stopper 67 is also provided. The fourth gear 65 rotates by rotation force from the third gear 63. The stopper 67 contacts the stopper 64. The shaft 46*d* has a one-way clutch 83. The one-way clutch 83 transfers rotation force only when the driving motor rotates in the reverse direction. When the driving motor rotates in the forward direction, the driving force is not transmitted to the shaft 46*d* and the fourth gear 65 runs idle. The fourth gear 65 rotates alternatively and synchronously with the driving motor, and the rotation force is transmitted to the fifth gear 74.

On the shaft 69 of the second gear 62, a first link element 70 is provided as shown in FIG. 14. The first link element 70 has a fork 70*a*, and the fork contacts cutter contact pin 71. The movement of the contact pin 71 controls cutter holder 46*b*'s movement. According to the alternating movement of the cutter contact pin 71, the first link element 70 rotates in alternating directions. The other fork element 70*b* contacts the pin 71*a* of the second link element 73. By the alternating rotation of the first link element 70, the second link element 73 rotates alternatively around the axis P. A fifth gear 74 is also provided on axis P. At the end of the second link element 73 is a sixth gear 75. The fifth gear 74 contacts the sixth gear. On shaft P of the fifth gear is a one-way clutch 85. A seventh gear 86 is also provided on shaft P. In this way the sixth and seventh gears are connected. The one-way clutch 85 transmits force when the driving motor rotates forward, which rotates the seventh gear 86. By this configuration, the force of the fourth gear 65 is transmitted to the sixth gear 75 through the fifth gear 74. Near the end of the second link element 73, the eighth gear 76 and ninth gear 77 are located. By the alternating movement of the second link element, the sixth gear contacts either the eighth gear 76 or the ninth gear 77. Thus the link gear is changeable when the motor rotates forward.

The eighth gear transmits rotation force through a tenth gear 78 and an eleventh gear 79 to a gear (not shown) that links the eleventh gear and the attachment roller 48. In this way the attachment roller is rotated. The tenth gear is located on the shaft of the tape-pulling roller 45. The ninth gear 77 is located on the shaft of rollers 49. A twelfth gear 88 is located at the opposite side of the shaft of the roller 49. The gears 77 and 88 rotate equally. The twelfth gear contacts a thirteenth gear 90 via an idle gear 89. The rotating force of the thirteenth gear is transmitted to the attachment roller 48 through the feed roller 41. By this structure, when the sixth gear 75 contacts either the eighth gear 76 or the ninth gear 77, the attachment roller 48 is rotated.

Figure 16:
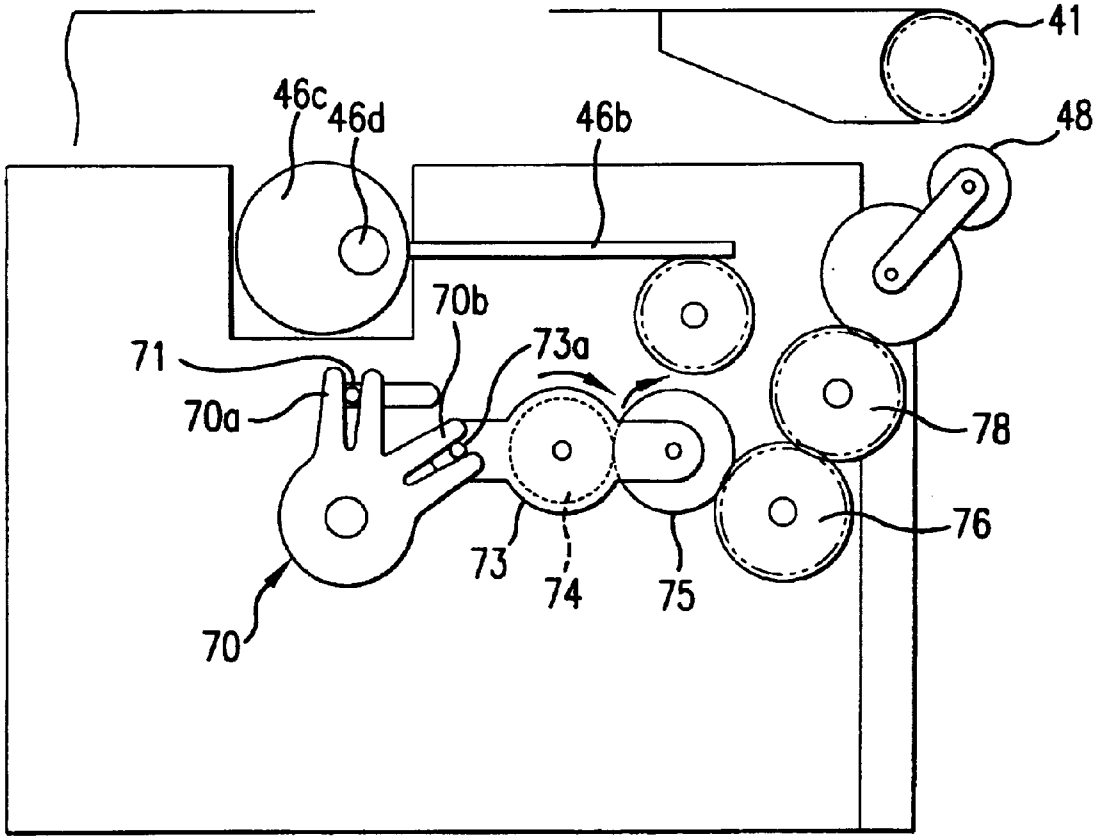
FIG. 16 shows the positions of the internal parts after the first forward motor rotation of the sixth embodiment.
Figure 17:
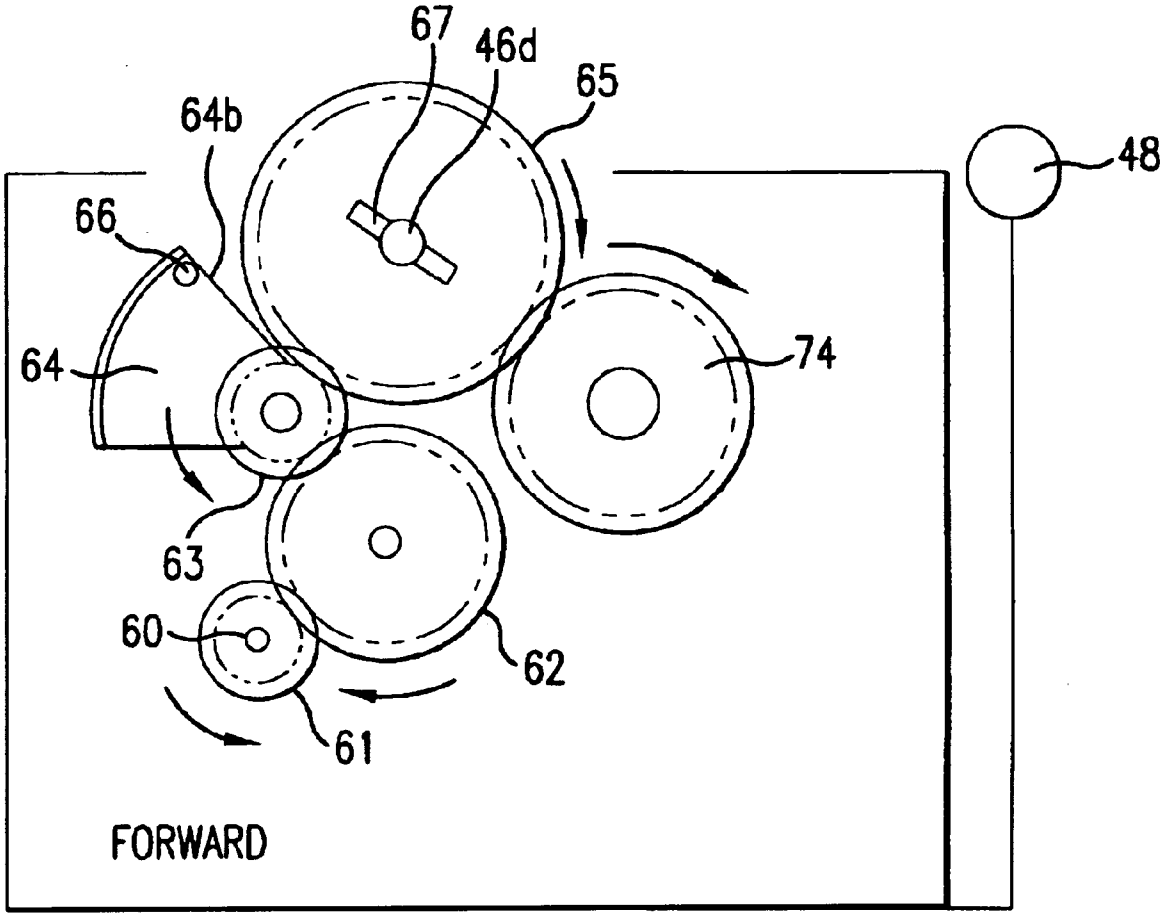
FIG. 17 shows the positions of the external parts after the first forward motor rotation of the sixth embodiment.

First, the forward rotation of the motor will be explained. This pulls the tape out from the roll. FIGS. 13–15 show the standard position. When the motor drives in the forward direction, as shown in FIGS. 16–17, the first, second, and third gears are rotated in the direction of the arrows. The stopper 64 rotates counterclockwise, and the inside edge portion 64*b* contacts the pin 66, which stops further movement. When the motor rotates in the forward direction, the rotation shaft 46*d* does not receive rotation force due to a one-way clutch 83. The eccentric cam 46*c* does not rotate, and the cutter edge 46*a* stays in the standard position. In that way, the seventh gear 75 is kept in the standard position and engages with the eighth gear 76. The one-way clutch 85 located on rotation shaft P transmits the driving force of the fifth gear 74 to the tenth gear 78. Pull-out roller 45 is rotated, and tape 44 is pulled out to a set length according to the amount of rotation of the pull-out roller. The pulled-out tape projects from the cutter apparatus 46.

Figure 18:
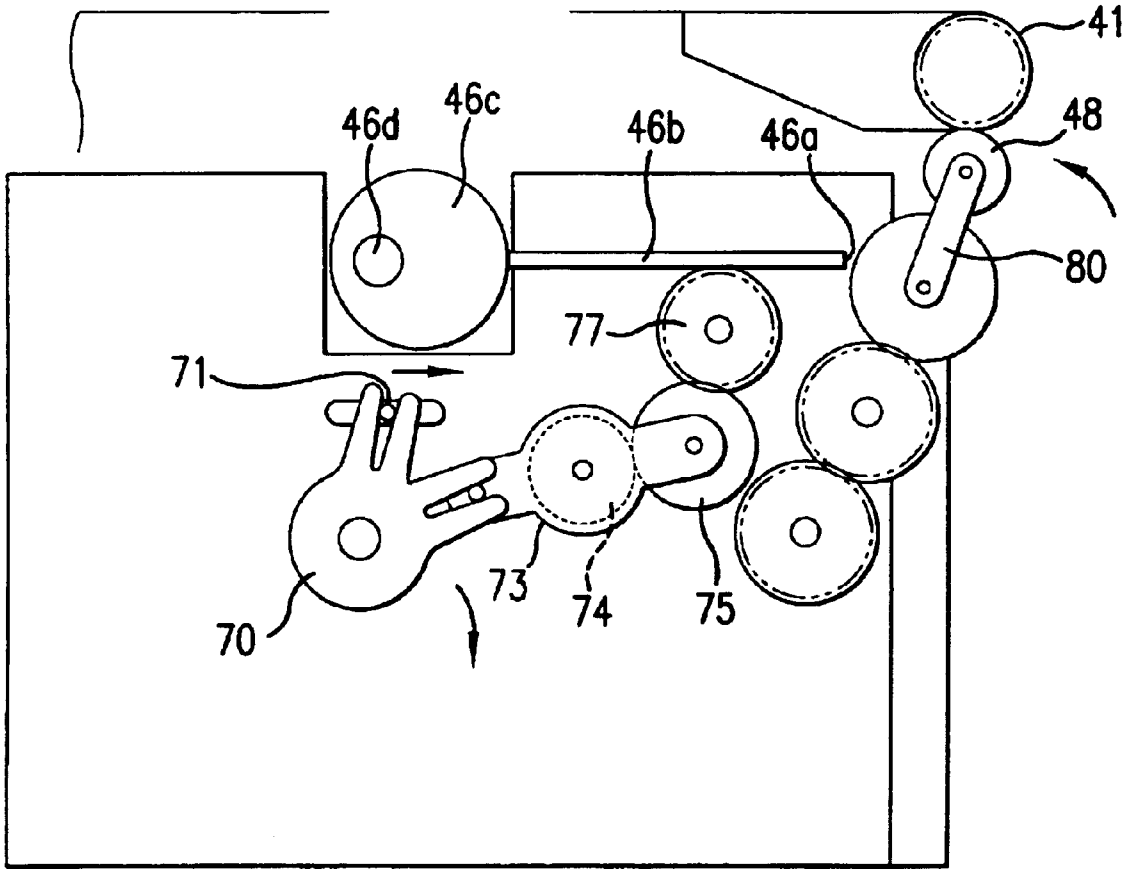
FIG. 18 shows the positions of the internal parts after the first reverse motor rotation of the sixth embodiment.
Figure 19:
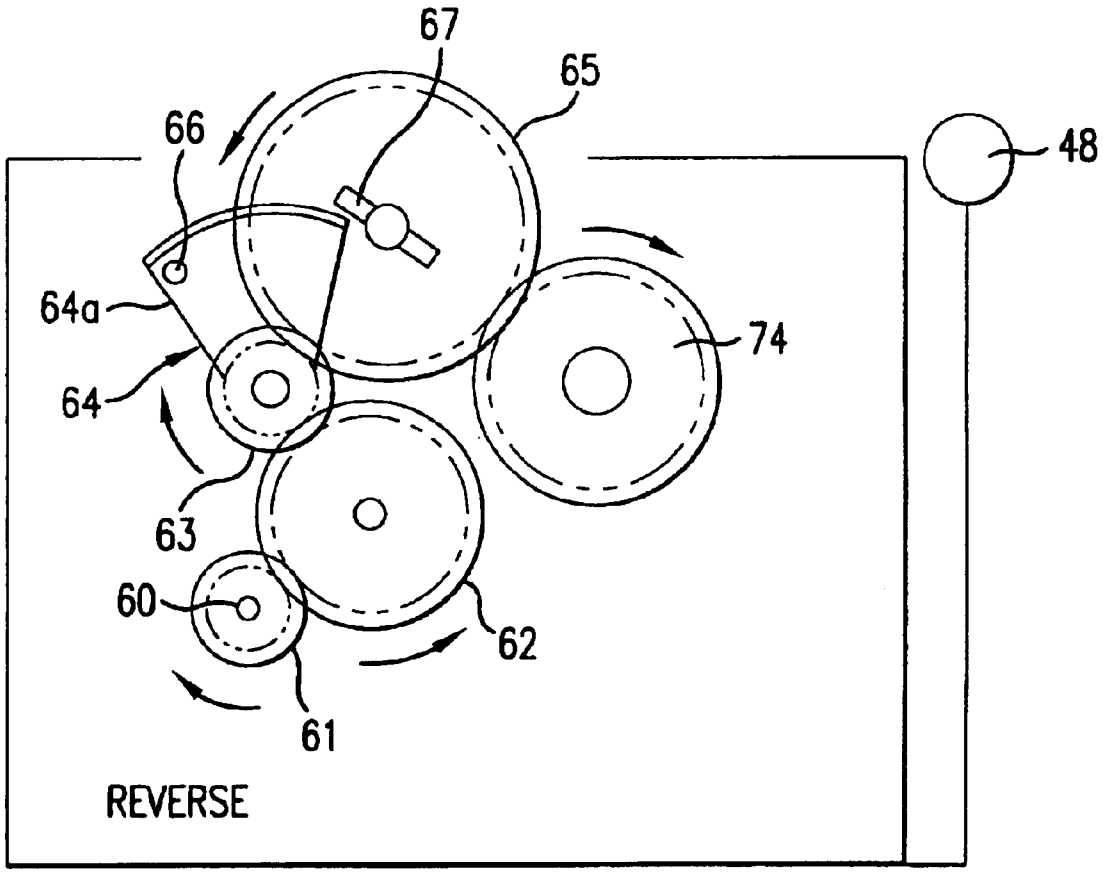
FIG. 19 shows the positions of the external parts after the first reverse motor rotation of the sixth embodiment.

Next is the reverse rotation operation, which involves the cutting of the tape to make the marker. As shown in FIGS. 17–18, the driving motor rotates in the reverse direction. This causes the first, second, and third gears to rotate in the opposite direction from before, as shown in FIGS. 18–19. The stopper 64 stops at a position shown in FIG. 19 when the inside edge 74*a* contacts pin 66. As the reverse rotation of the driving motor starts, the stopper 64 and the cutter shaft stopper 67 are not touching, and the shaft 46*d* can rotate, as shown in FIG. 17. When the driving motor begins reverse rotation, the one-way clutch 83 transmits driving force. Then by the rotation of the fourth gear 65, the eccentric cam 46 rotates. The eccentric cam moves the cutter holder and cutter edge forward. When the eccentric cam rotates 180 degrees, the cutter stopper 64 is in the position shown in FIG. 19. The cutter shaft stopper 67 contacts the stopper 64, and further rotation is prevented. The cutter edge 46*a* is stopped exactly at the most forward position, where it stays. As the cutter edge moves forward, it cuts the tape 44. A marker is formed from the extended part of the tape. According to the forward movement of the cutter holder 46*b*, the attachment roller 48 moves forward and contacts the feed roller 41 as in the fifth embodiment. Additionally in this embodiment, the cutter contact pin 71 moves forward with the cutter holder 46*b*, as shown in FIG. 18. The first link element 70 rotates counterclockwise, and the second link element rotates clockwise. The sixth gear 75 on the end of the second link element 73 engages the ninth gear 77. During the reverse rotation of the driving motor, the fifth gear 74 rotates, but the sixth gear 75 and ninth gear 77 do not rotate because of the one-way clutch 85.

Figure 20:
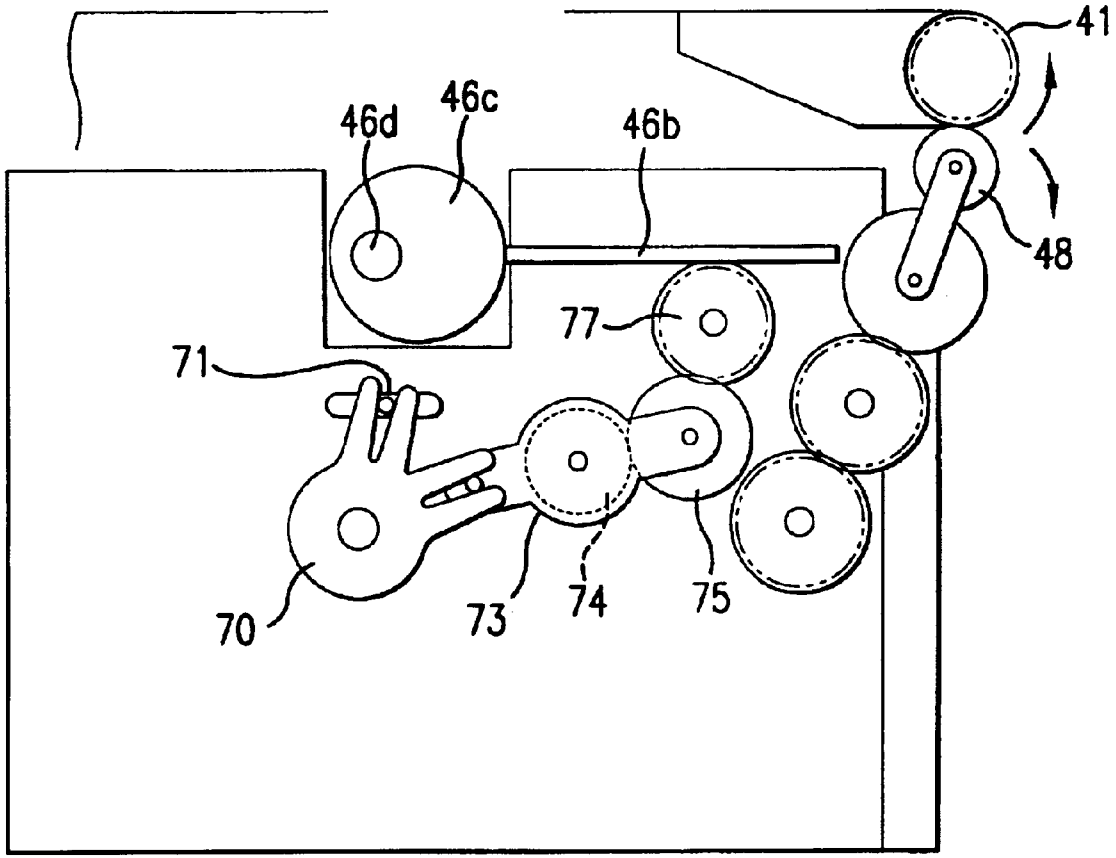
FIG. 20 shows the positions of the internal parts after the second forward motor rotation of the sixth embodiment.

After that process, the driving motor changes direction again to start a second forward rotation period. In this period the marker is fed and adhered to the sheet. From the position of FIGS. 18 and 19, the driving motor rotates forward. Then in FIGS. 20 and 21, the first gear 61, second gear 62, and third gear 63 rotate in the direction of the arrows. Finally the cutter stopper 64 stops at the position shown in FIG. 21. The fourth gear 65 rotates when the driving motor rotates forward. The driving force of the motor is blocked by the one-way clutch 83, and the rotation shaft 46*d* and eccentric cam 46*c* do not turn. Accordingly the cutter holder 46*b* remains in the forward position, and the cutter contact pin 71 does not move. The first link element 70 and the second link element 73 remain in the position from the previous process. The forward rotation of the driving motor and the one-way clutch 85 cause the ninth gear 77 to rotate. Accordingly, the roller 49 is rotated, and the marker 47 is fed. On the opposite side of the apparatus, the twelfth gear 88, idle gear 89, and thirteenth gear 90 rotate as well. Thus the attachment roller 48 rotates. Then, the cut marker 47 is adhered to the lower side portion of the sheet 42.

Figure 21:
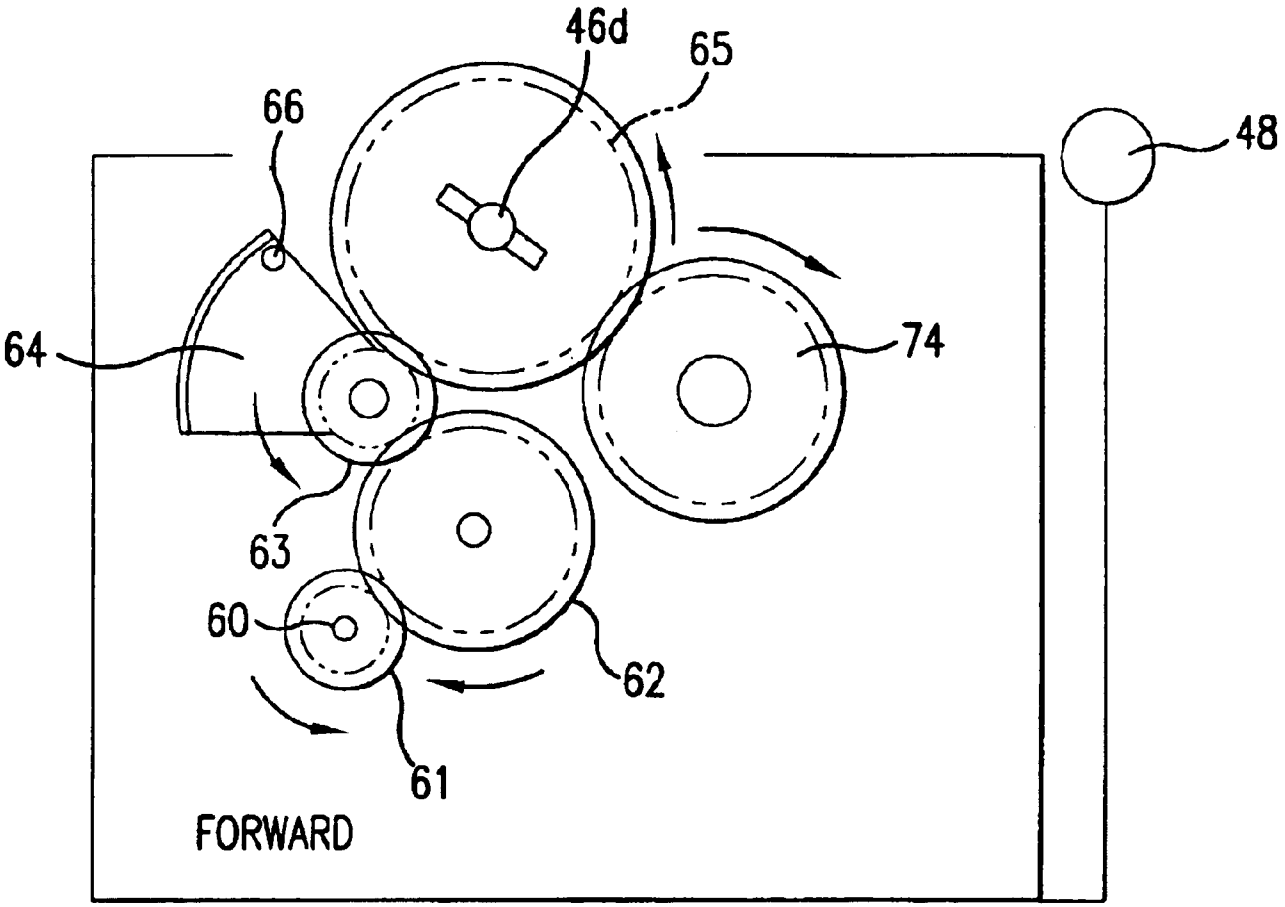
FIG. 21 shows the positions of the external parts after the second forward motor rotation of the sixth embodiment.

This marks the start of the second reverse rotation of the driving motor, which returns the apparatus components to their standard positions. From the position in shown in FIGS. 20 and 21, the driving motor rotates in the reverse direction. The first gear 61, second gear 62, arid third gear 63 rotate as shown in FIG. 19. The cutter stopper 64 stops as shown. At the start of reverse rotation, as shown in FIG. 21, the cutter stopper 64 and cutter shaft stopper 67 have not contacted each other, and the shaft 46*d* is free to rotate. By the rotation of the fourth gear 65, the eccentric cam 46*c* also rotates. The cutter holder 46*b* and edge 46*a* move backwards. When the eccentric cam 46*c* rotates 180 degrees, the mechanisms become as shown in FIGS. 13 and 14. They then are prepared for the next adhering process. Continuous operation, from making the marker to adhering it to the sheet, is operated by a single driving motor. The improvements in the fourth, fifth, and sixth embodiments of course apply to the first embodiment. Similarly, the second and third embodiments can be applied to the fourth, fifth and sixth embodiments.

Figure 22:
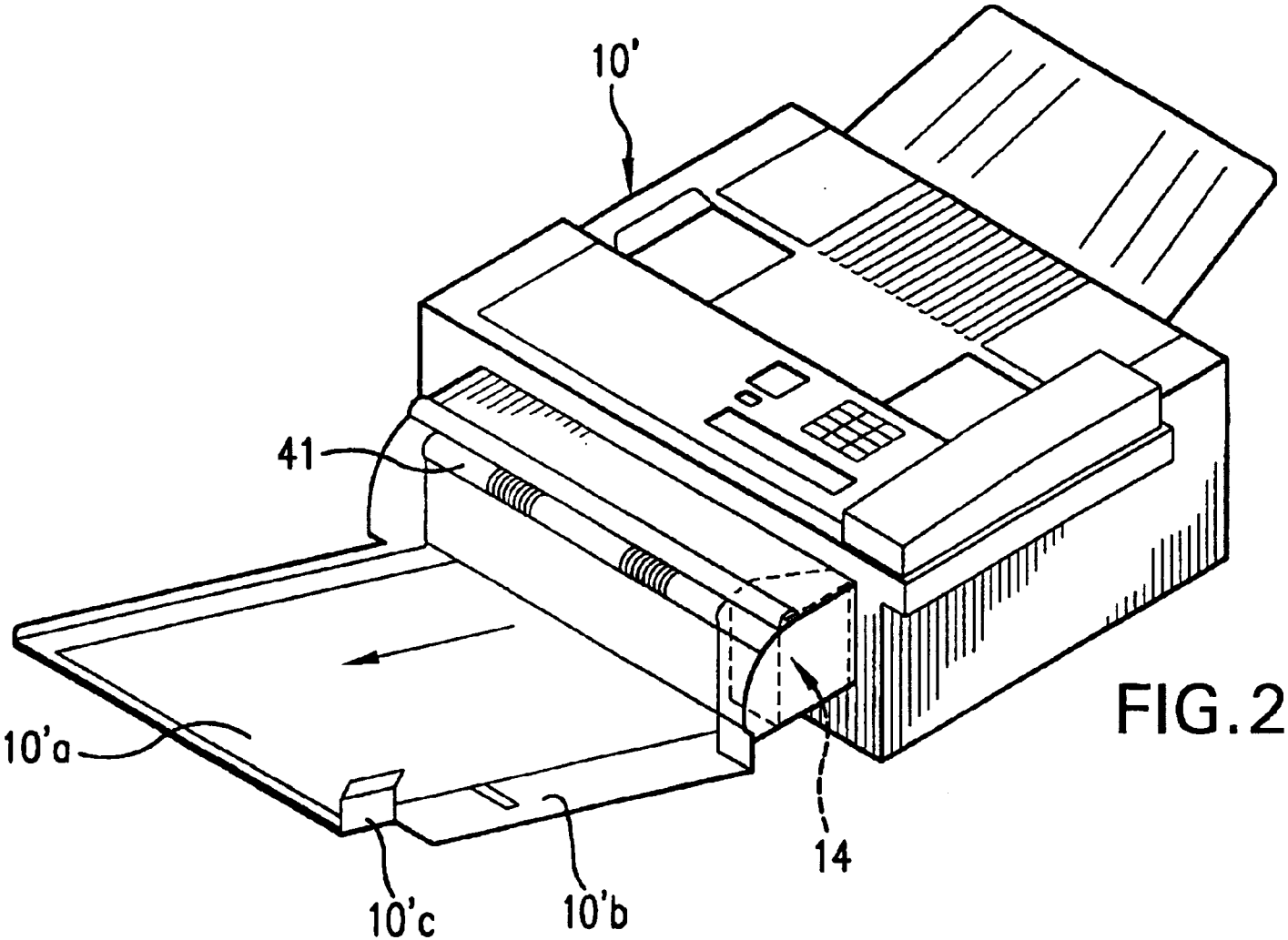
FIG. 22 is a perspective view of the seventh embodiment of a sheet sorting apparatus of the invention.

Each embodiment discussed so far is applied to the marker attaching mechanism of a sorting apparatus for an image forming apparatus. The marker adhering mechanism is located at the exit of the image forming apparatus and operates the ejected sheets which are printed. However, this invention is not limited to these embodiments. For example, it can apply to an image reading apparatus. An example is shown in FIG. 22. The sheet sorting apparatus 14 is located at the exit of facsimile 10'. A marker is adhered to a sheet when the sheet moves through the sorting mechanism 14, and the sheet is piled on the output tray 10'*a*. If some documents are sent to different persons, they can be marked by group. This also applies to receiving documents.

In this invention, the side edge part 10'*b* of tray 10'*a* is open. By this structure, the marker adhered to the sheet is located in the open area. Then, the marker is not bent and the position of the marker is easily recognized. There is a guide plate 10'*c* on the front part of the tray. This keeps the sheets in alignment and prevents them from falling off the tray.

For the complete structure of the sheet sorting apparatus 14, each embodiment can be applied. For other embodiments, such as those shown in FIGS. 23–26, a different structure is described. This is the seventh embodiment of the sheet sorting apparatus of the invention. Of course, the seventh embodiment can be applied to the exit part of an image processing apparatus.

Figure 23:
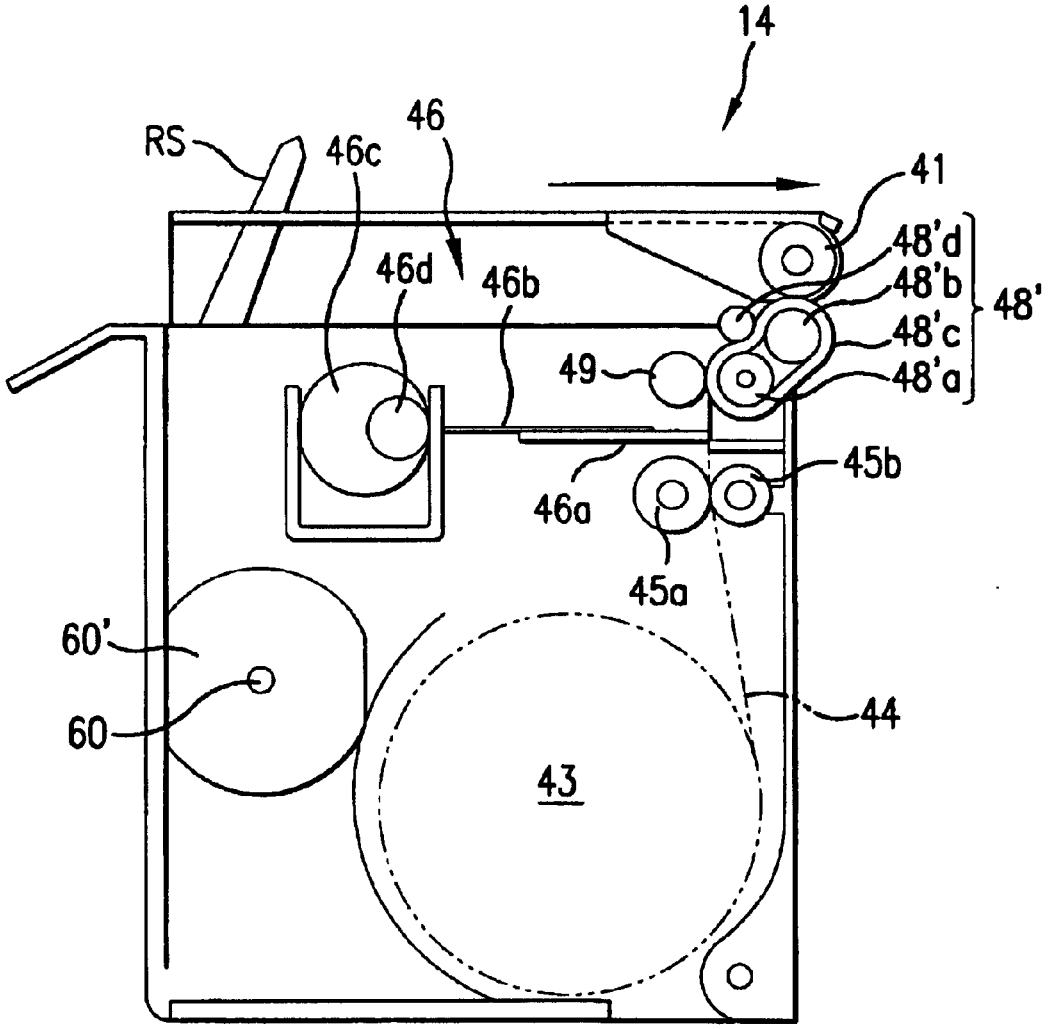
FIG. 23 is the inner structure of the seventh embodiment.

In the seventh embodiment, the structure is the same as in the sixth embodiment. The main difference is the replacement of the marker adhering roller 48 with an adhering belt unit 48'. Some of the parts that transfer the driving force are also different. As shown in FIG. 23, driving pulley 48'*a*, responding pulley 48'*b*, endless belt 48'*c*, and tension roller 48'*d* are located with some resistance. The tension roller is provided to give a set amount of tension. It feeds the marker along with the belt 48'*c*.

When the driving pulley 48'*a* rotates in the clockwise direction, the endless belt 48'*c* feeds a marker. The marker adhering belt unit 48' can swing in a predetermined range, and when it is in the up position the belt and feeding roller contact and a marker is pressed to a sheet as it is fed.

The marker adhering belt unit 48' has the same functions as the adhering roller 48: move, stop, and swing up and down. Synchronized with the movement of the belt, the cutter edge 46*b* of the cutter apparatus moves back and forth it cuts the tape spooled out from the roller 43 at a preset time, and then the newly-made marker is attached to the sheet. In this embodiment the driving motor 60' alternately rotates. The driving force is transmitted by a system of gears. The sheets are moved from the making to the adhering of the marker by a single driving motor.

Figure 24:
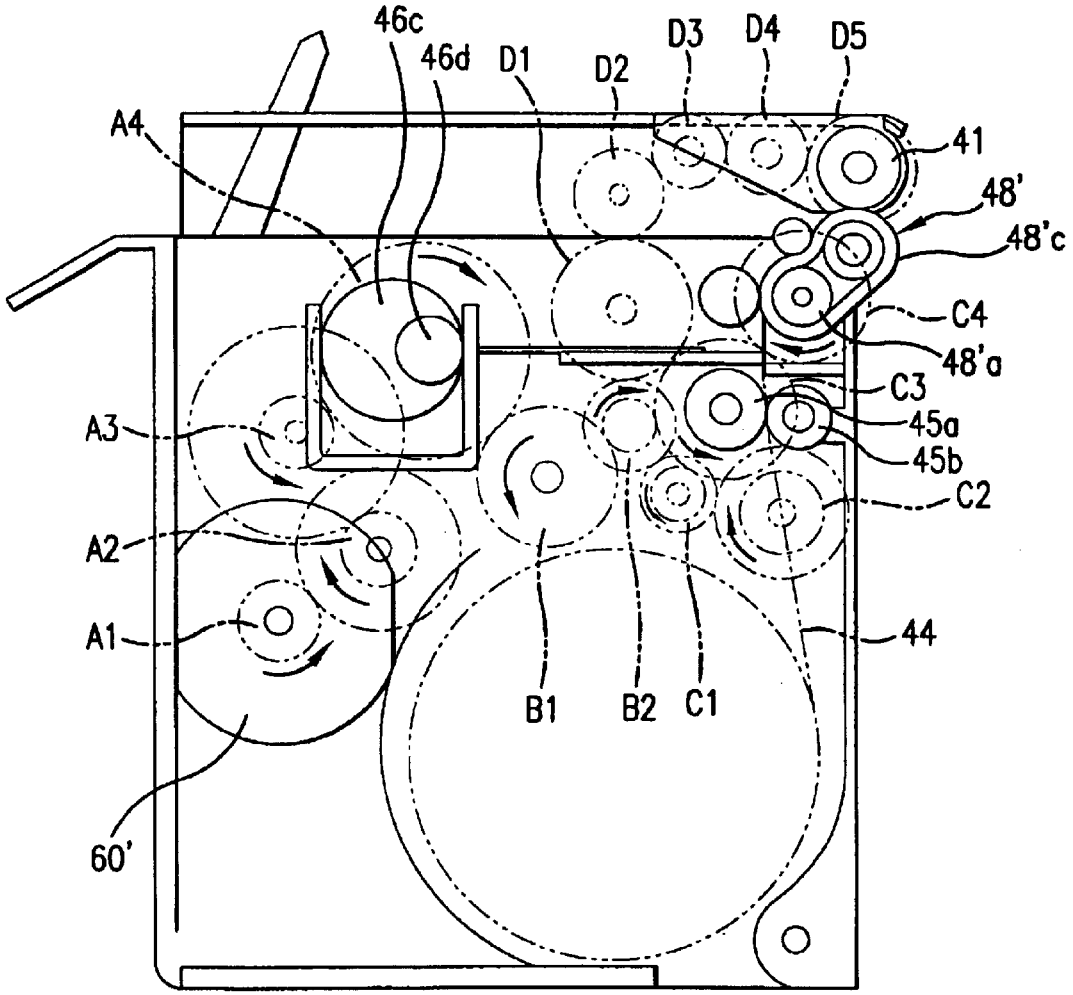
FIG. 24 shows the positions of the parts during the first forward motor rotation of the seventh embodiment.

Next the mechanism of the driving force is described. As shown in FIG. 24, gears A1, A2, A3, and A4 transmit the driving force from the driving motor 60' to the rotation shaft 46*d* of the eccentric cam 46*c*. The gears A1 through A4 correspond to the gears 61, 62, 63, and 65 in the sixth embodiment. Gear A4 contacts gear B1, and the driving force of gear B1 is transmitted to gear B2. A one-way clutch is provided on gear B1, so that any time it rotates counterclockwise, gear B2 also rotates. Gear B2 contacts either gear C1 or gear D1 and transmits the driving force alternately. Gear B1 corresponds to fifth gear 74 in the previous embodiment, gear B2 corresponds to sixth gear 75, gear C1 corresponds to eighth gear 76, and gear D1 corresponds to ninth gear 77. Gear C1 provides the driving force to gear C4. The pull-out rollers 45*c* and 45*b* connected to C3 are rotated. The pull-out roller 45*b* is a dependent roller, and its rotation depends on the roller 45*a*. Gear D1 provides the driving force to gears D2–D5, causing the feeding roller 41 connected to the gear D5 to rotate.

As shown in FIG. 24, the driving motor 60' rotates counterclockwise. Accordingly, the A gears rotate in the direction of the arrows and transmit the driving force to the B gears. Gear B1 rotates counterclockwise, and gear B2 rotates clockwise. Gear B2 engages gear C1, and the C gears rotate as indicated. Then the pull-out rollers 45*a* and 45*b* pull out the tape 44 to a set length. This is the pull-out step, and next is the tape cutting step.

Figure 25:
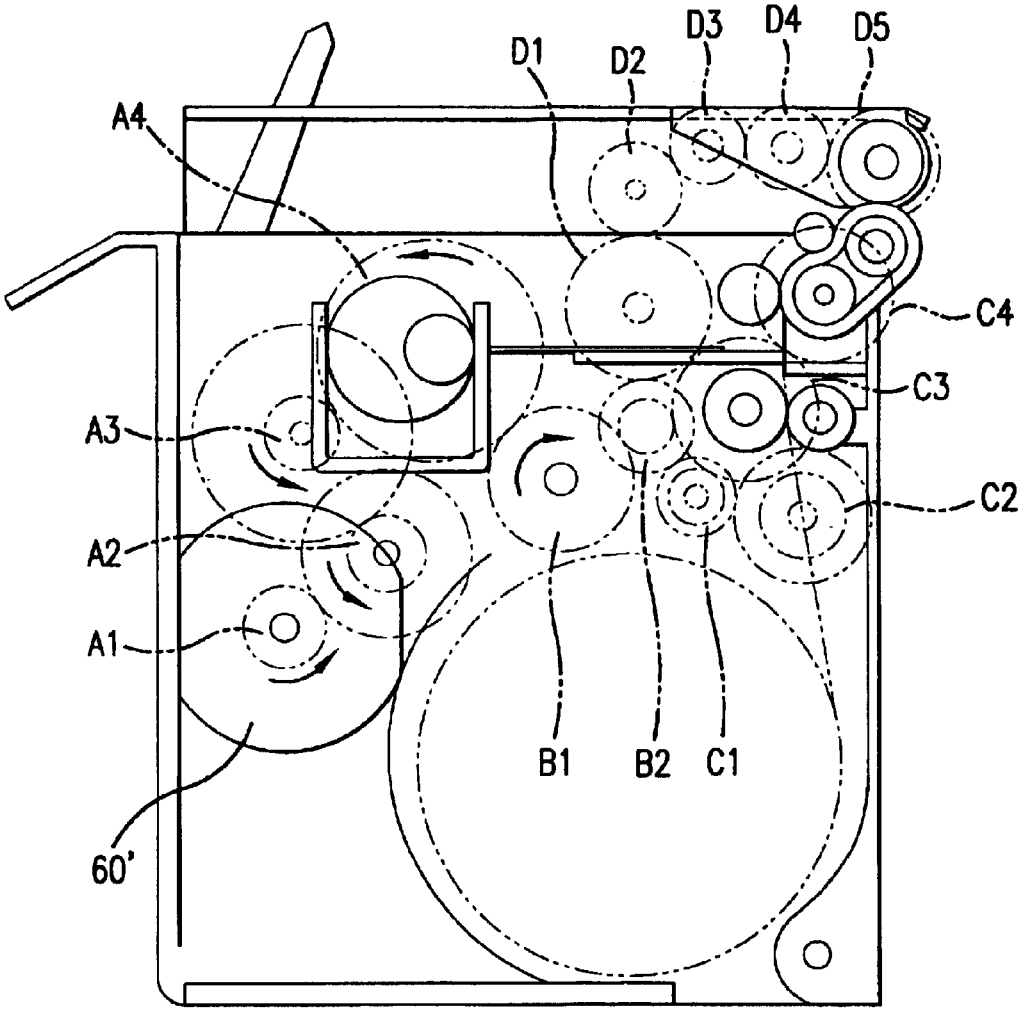
FIG. 25 shows the positions of the parts during the reverse motor rotation of the seventh embodiment.

As shown in FIG. 25, the driving motor rotates clockwise. The A gears rotate as indicated, and gear B1 rotates clockwise. Due to the one-way clutch, gear B2 does not rotate, and the C gears are not turned. The pull-out rollers and adhering belt do not move. By the counterclockwise rotation of gear A4, the eccentric cam 46*c* rotates and the cutter edge 46*a* moves forward. The tape 44 is cut, and a marker is manufactured. By a similar structure to the fifth and sixth embodiments, the marker adhering belt 48'*b* moves upward, corresponding to the movement of the cutter edge. The marker and sheet are pressed together by the belt 48'*c* and the feeding roller 41.

Figure 26:
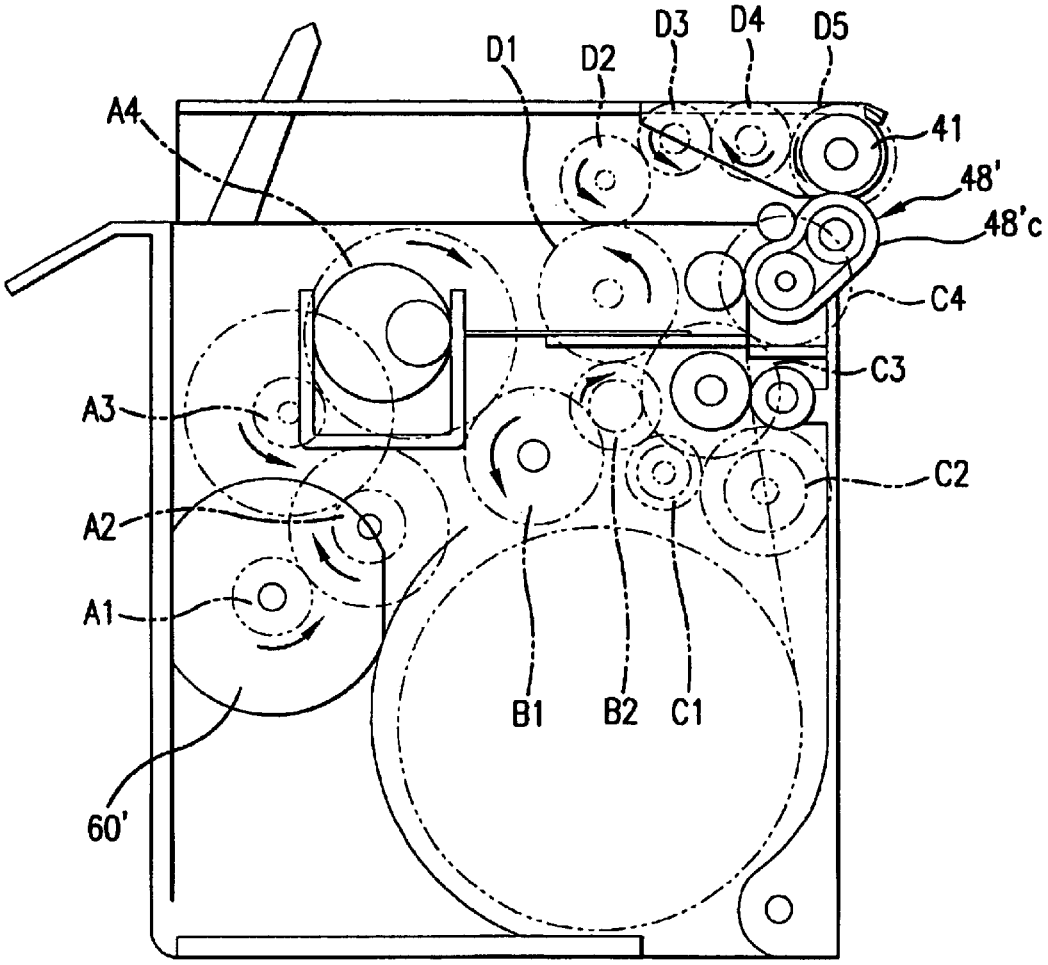
FIG. 26 shows the positions of the parts during the second forward motor rotation of the seventh embodiment.

As shown in FIG. 26, the driving motor 60' again rotates counterclockwise. Accordingly, as in the tape cutting step, the A-named gears rotate as indicated by the arrows and transmit the driving force. Gear A4 is connected to the shaft 46*d* through a one-way clutch. Accordingly the eccentric cam 46*c* does not rotate, and the cutter edge remains in the forward position. The adhering belt 48' and the feeding roller 41 hold the sheet and marker. Gear B1 rotates counterclockwise and drives gear B2. Gear B2 engages gear D1, and the D gears rotate as indicated. By the D gears, the feeding roller 41 rotates. Accordingly, the sheet and marker are fed, and by the adhesive material on the marker, the marker is adhered to a predetermined position on the sheet.

After the adhering process finishes, the driving motor 60' rotates in the reverse direction (clockwise). As in the tape cutting process, gear B2 is not driven, and gear A4 rotates counterclockwise. Then the eccentric cam 46*c* rotates and the cutter backs up to its original position. By their movement, the next cutting process is prepared and the dependent roller 48'*b* of the adhering belt 48' moves downward and the endless belt 48'*c* and feed roller 41 are separated. Then there is no feeding pressure from the attachment belt.

This process is repeated each time a marker is adhered. In the sixth and seventh embodiments, a driving motor is provided. However, in this invention, a driving motor is not required. Power could be provided externally, either from the image processing apparatus or another source.

In FIG. 23, RS is a limit switch to detect the passage of sheets. When a sheet is detected, the driving motor 60' starts to rotate. The time from detection to start of rotation can be varied. When the time is the same, the adhering position of the marker is the same. If the time is varied, the position is changed.

In the seventh embodiment, this sorting apparatus is applied to a facsimile device as an image reading apparatus, but the invention is not limited to only the applications in the embodiments. For example, by the results of OCR recognition of characters, a marker may be adhered to a sheet which has a bad recognition rate to show where the recognition error occurred.

Figure 27:
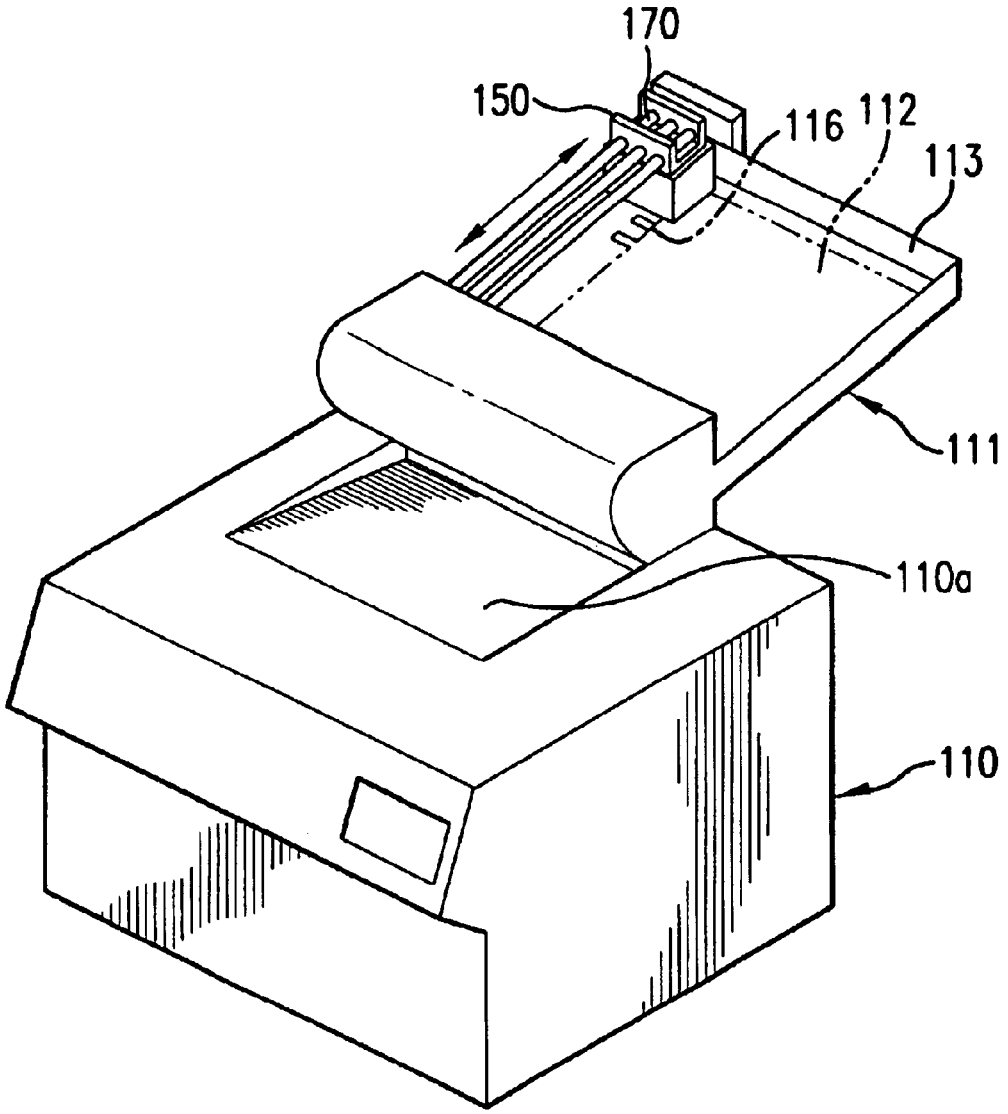
FIG. 27 is the eighth embodiment of a sheet sorting apparatus of the invention.
Figure 28:
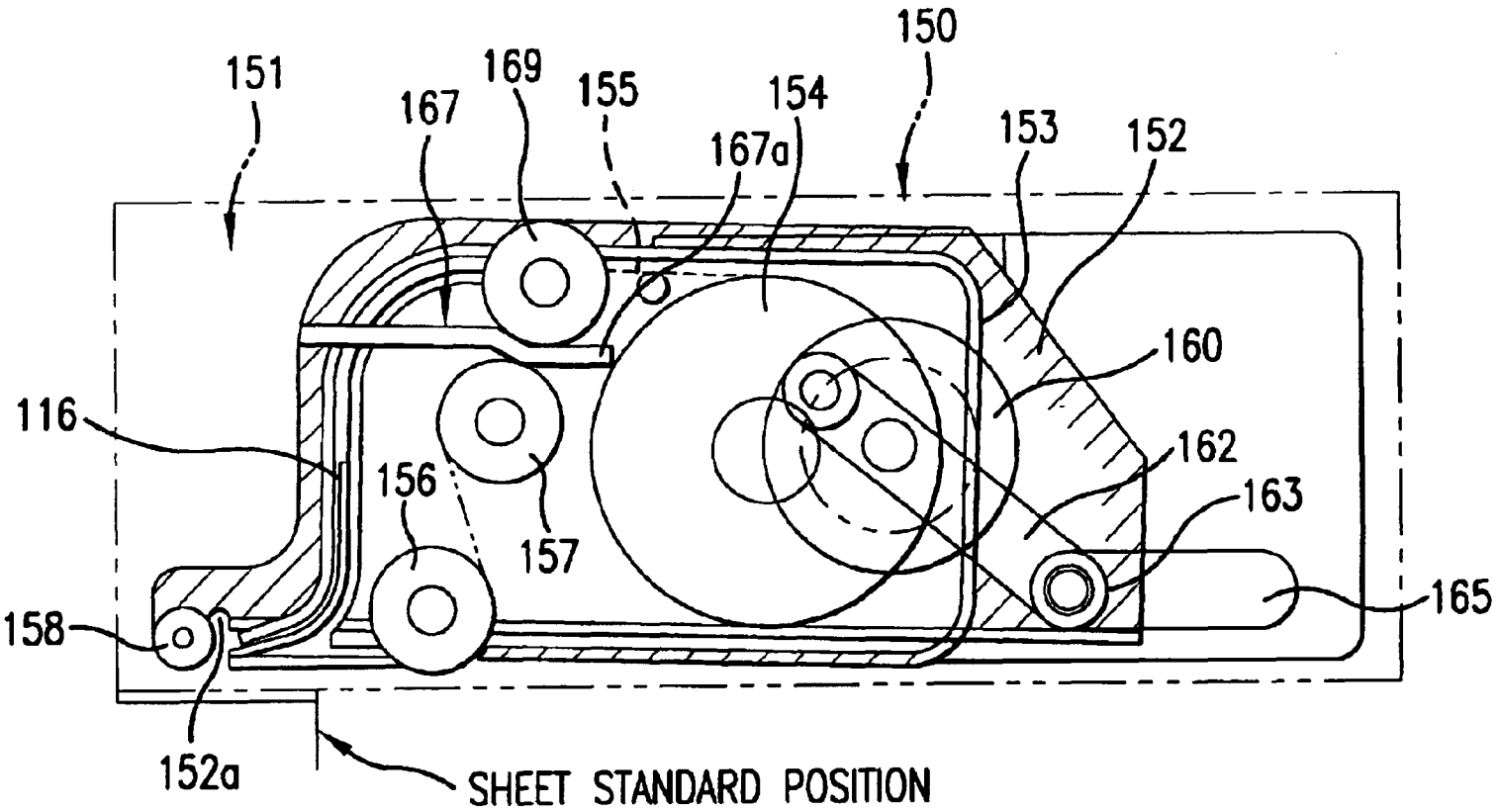
FIGS. 28–32 are the inner structures of the eighth embodiment.

FIG. 27 shows the eighth embodiment of the,sheet sorting apparatus of this invention. In this embodiment, a marker 116 is adhered to a sheet 112, and the sheet is then piled on the tray 113. The sheet sorting apparatus body 150 contains the marker adhering unit. The inner mechanism is shown in FIG. 28. In FIG. 28, a movable unit 152 is provided inside casing 151. The unit 152 is forced upwards by a plate spring 153. In the normal state shown in FIG. 28, the top end portion of the unit 152 is lifted up.

In the unit 152, a marker roll 154 is provided. The roll 154 is made of backing paper 155 to which a row of evenly spaced adhesive markers 116 is attached. The unwound end of the backing paper 155 is introduced into an outlet 152*a* of the unit 152. The backing paper 155 turns at the outlet 152*a*, and the marker attached to the paper is removed. Then the removed marker is attached to the sheet below the outlet. The pressure roller 158 presses the marker against the sheet.

Figure 29:
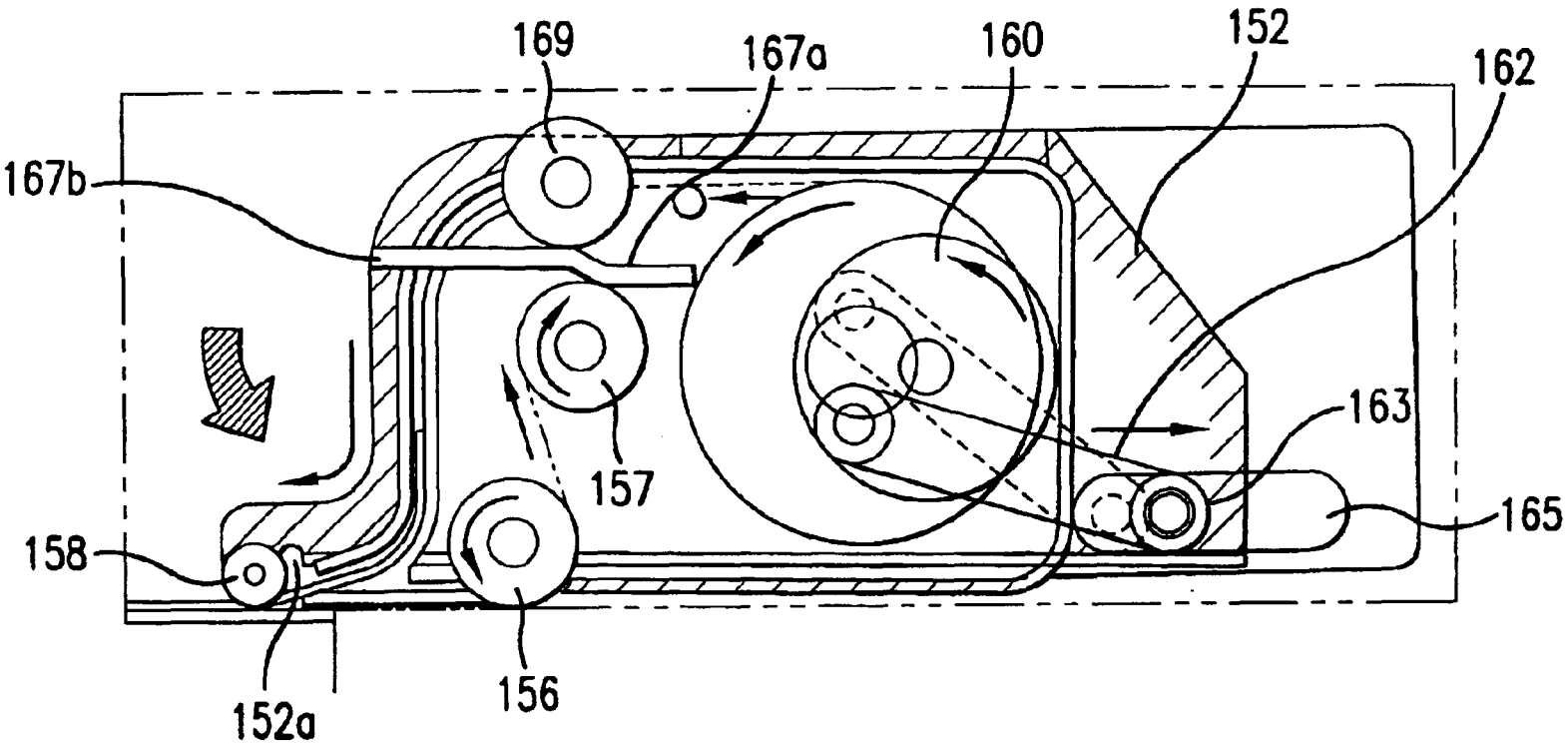
Figure 30:
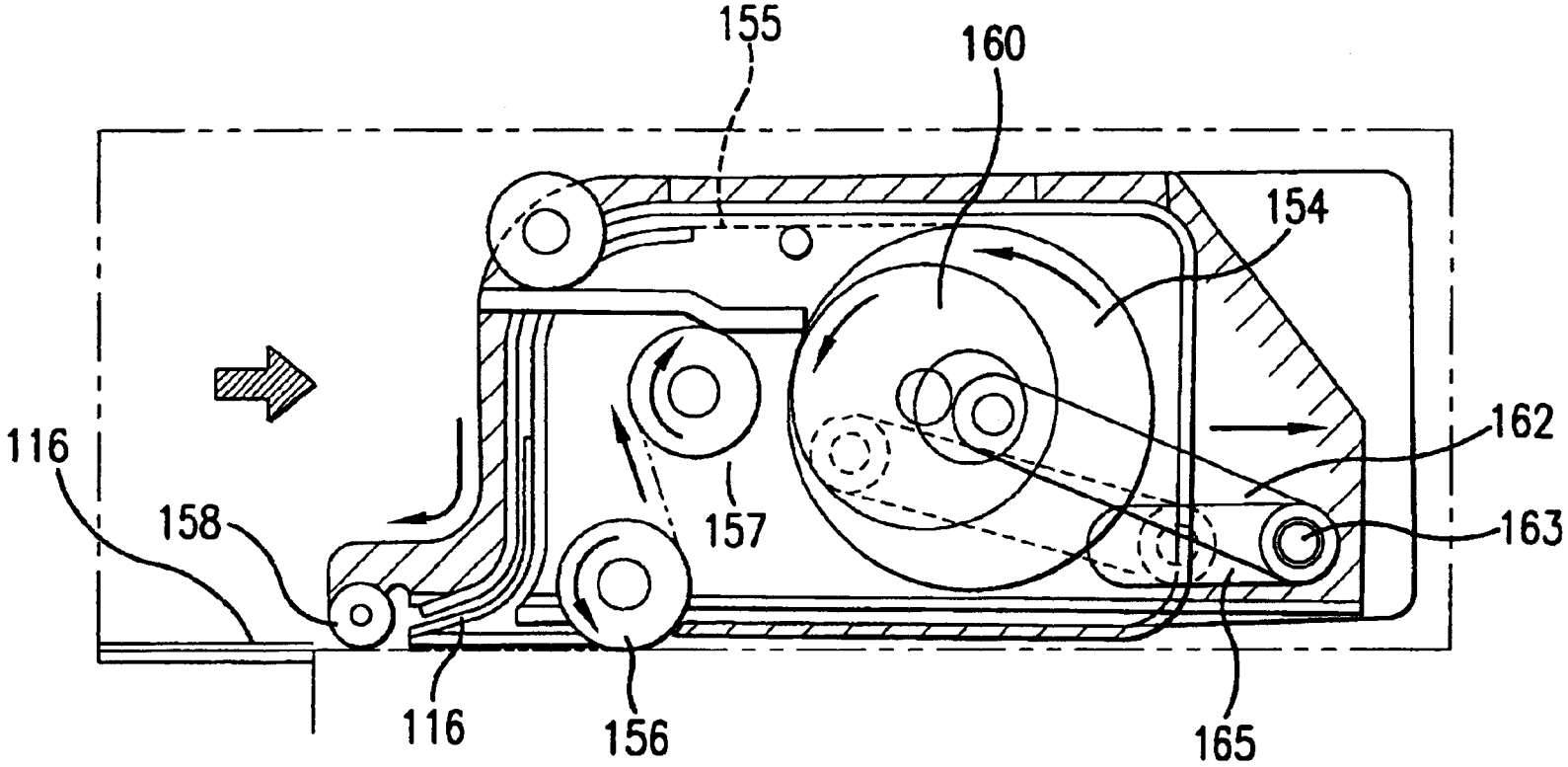

The unit 152 has a movable link mechanism. A bar 162 is linked to a round wheel 160. The wheel is turned by a motor (not shown). The bar 162 has a guide pin 163, which is inserted in a guide hole 165 in the casing 151. Driven by the turning of the wheel, the guide pin moves back and forth in the hole, and the unit 152 moves accordingly. There is a guide rail 167 in the unit 152, and the guide rail contacts a roller 169. The guide rail is bent so that the end portion 167*a* is lower than the base portion 167*b*. In the normal state shown in FIG. 28, the roller 169 contacts the lower portion of the guide rail 167*a*. When the unit 152 moves backwards according to the turning of the wheel 160, the roller 169 contacts the base portion of the guide rail 167*b*. As shown in FIGS. 29 and 30, the unit 152 is forced downwards by the action of the roller 169. Both the roller 169 and the wheel 160 are mounted on the casing.

When a sheet is exiting beneath the apparatus, the motor is driven and the wheel 160 turns. Then as shown in FIG. 29, the outlet 152*a* moves downwards, and the top of the marker 116 contacts the sheet under the unit. Due to the turning, of the wheel 160, the unit 152 moves to the right, and the roll 154 and rollers 156 and 157 turn as shown in FIG. 29. Then the backing paper 155 is pulled out and the marker is pulled out with it. The backing paper turns sharply at the outlet 152*a*, causing the marker 116 to be removed and placed by the roller 158.

Figure 31:
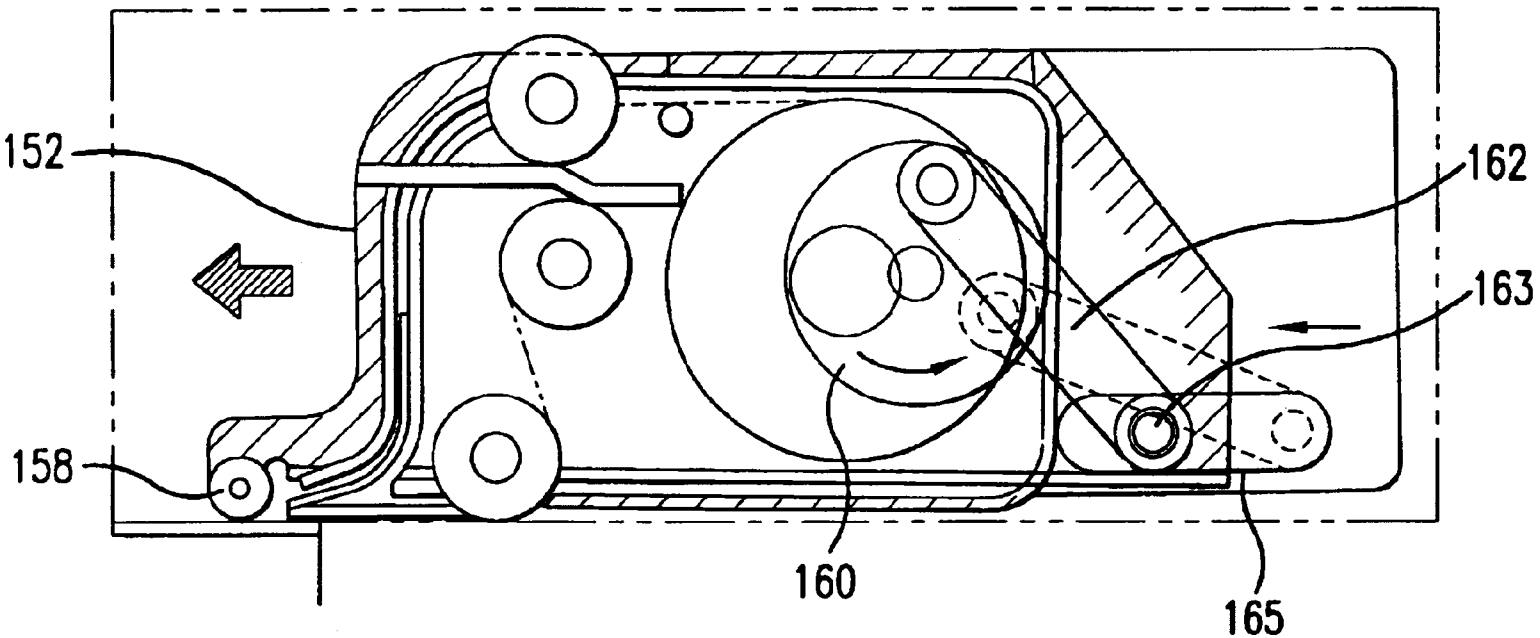

As the wheel 160 continues to turn, the unit 152 moves completely to the right side of the casing, as shown in FIG. 30. The marker adhering process is finished, and the next marker is waiting in the outlet 152*a*. By the turning of the wheel, the unit 152 moves back to the left, as shown in FIG. 31. When the unit moves backwards, the backing paper is not pulled out due to a one-way clutch mechanism which cuts the driving force.

Figure 32:
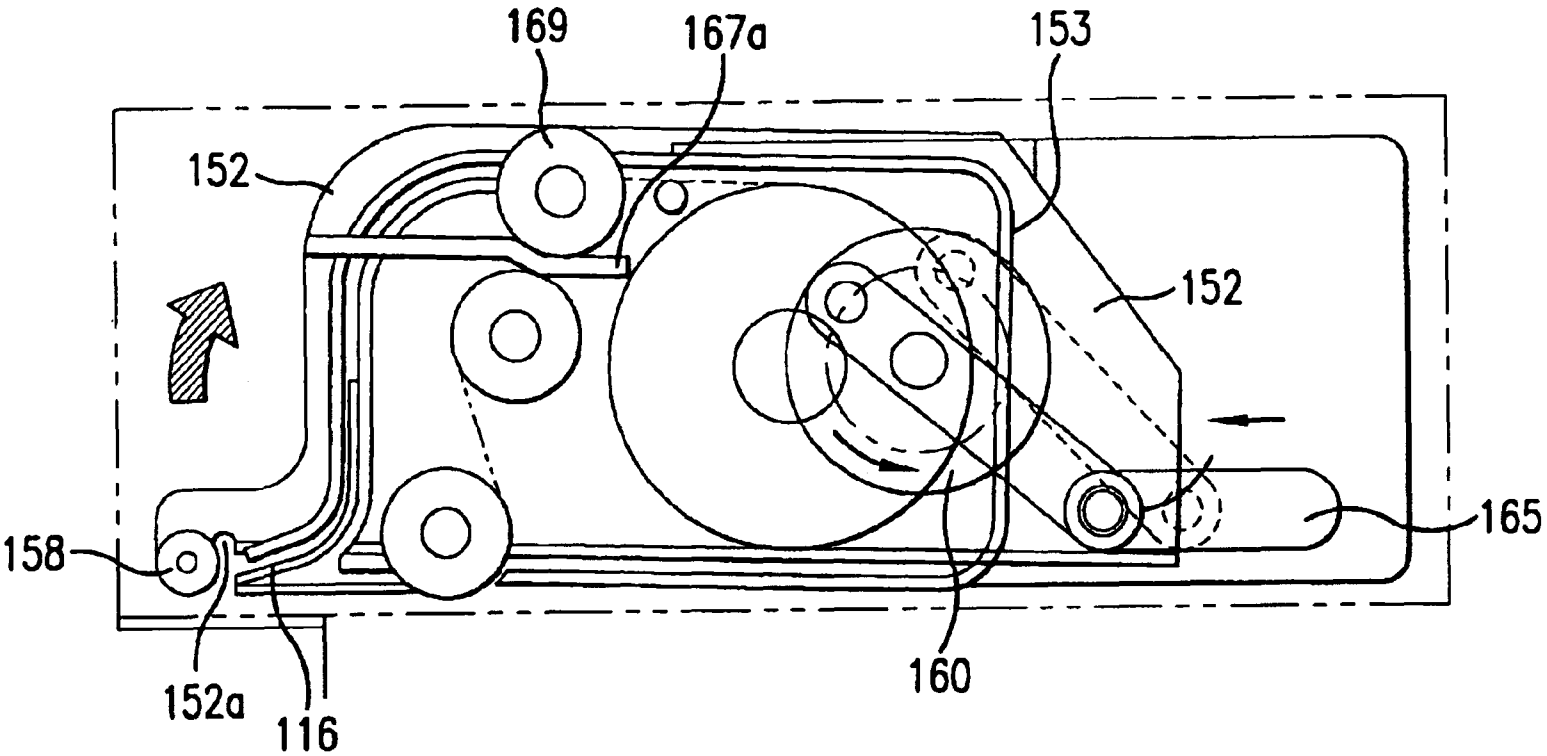

After the wheel 160 has rotated a complete 360 degrees, as shown in FIG. 32, the roller 169 is again in contact with the end portion 167*a* of the guide rail. The outlet side of the unit is lifted up by the recovery force of the plate spring 153. To attach the next marker the cycle is repeated.

As shown in FIG. 27, the sheet sorting apparatus body 150 is movable along a guide rod 170. By this mechanism, the marker adhering position is changeable. The mechanism is shown in detail in FIG. 33. The sheet sorting apparatus body 150 is mounted under a mount 171. A pair of guide rods 170 and a screw bolt 172 is provided through the mount 171. By the turning of a screw bolt 172, the sheet sorting apparatus body's position is changeable to adjust the attaching position.

In the embodiment mentioned above, the sheet sorting apparatus body's position is changed in line with the sheet feed direction. Of course, the sheet sorting apparatus body may also be moved across the path of the sheet, as shown in FIG. 34.

Figure 33A:
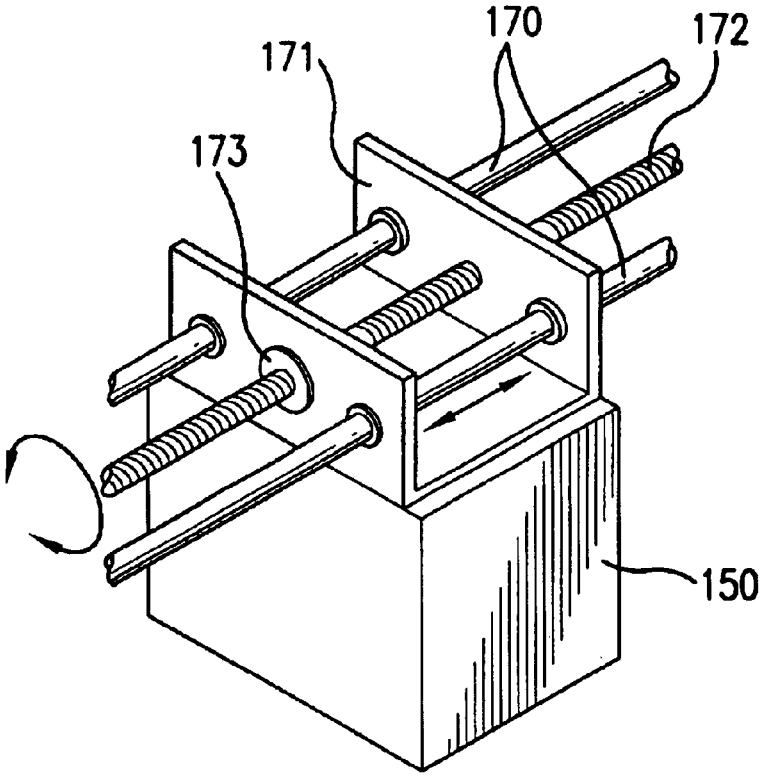
FIG. 33 shows the mechanism of the eighth embodiment.
Figure 33B:
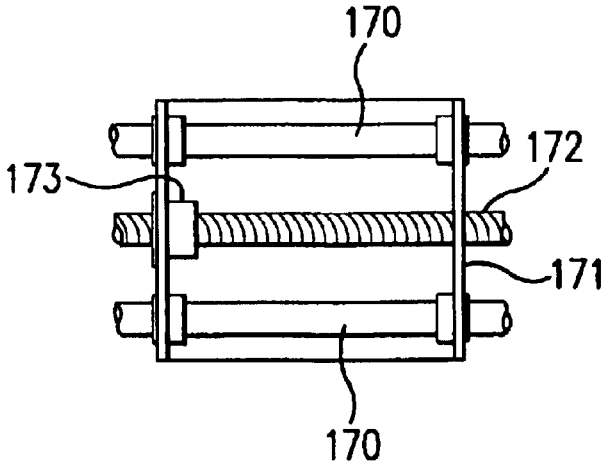
Figure 34:
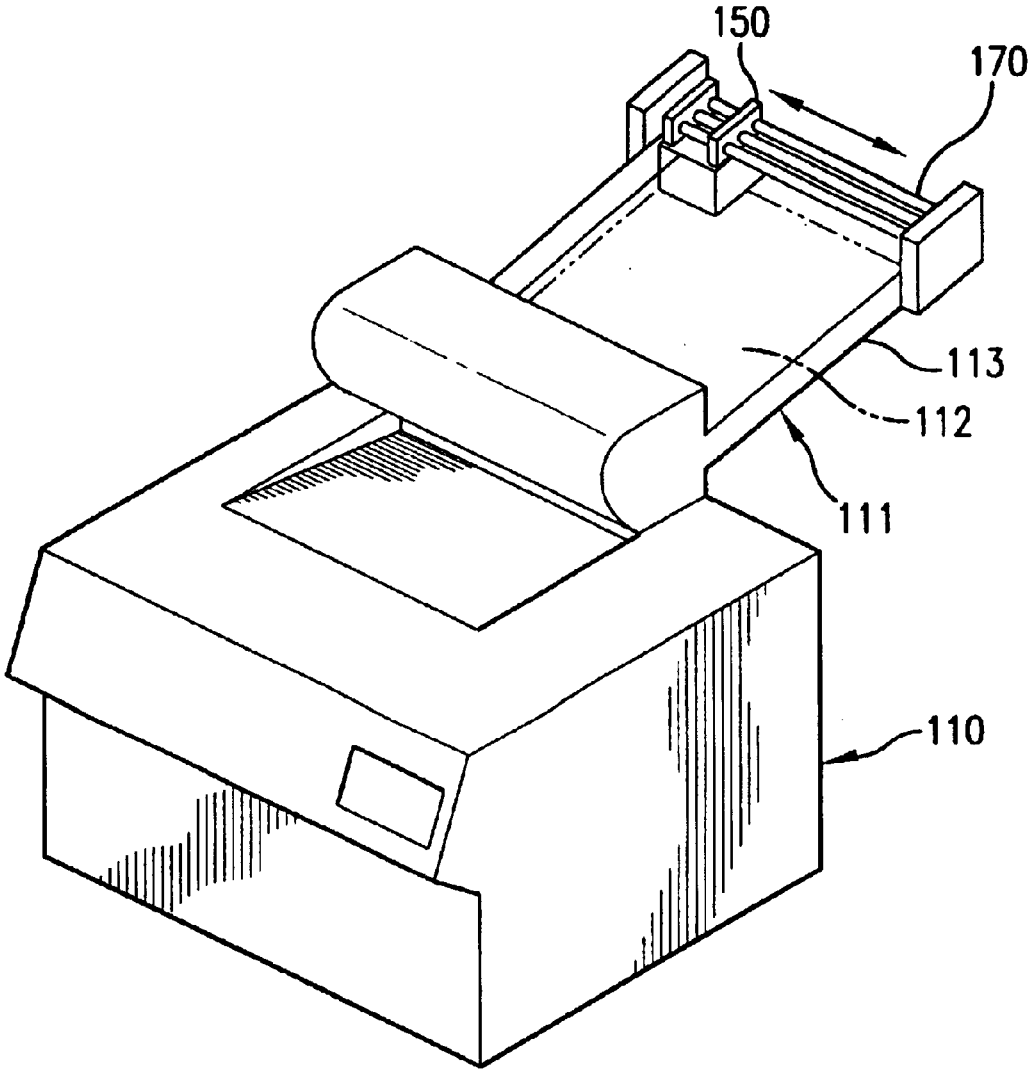
FIG. 34 is the ninth embodiment of a sheet sorting apparatus of the invention.
Figure 35:
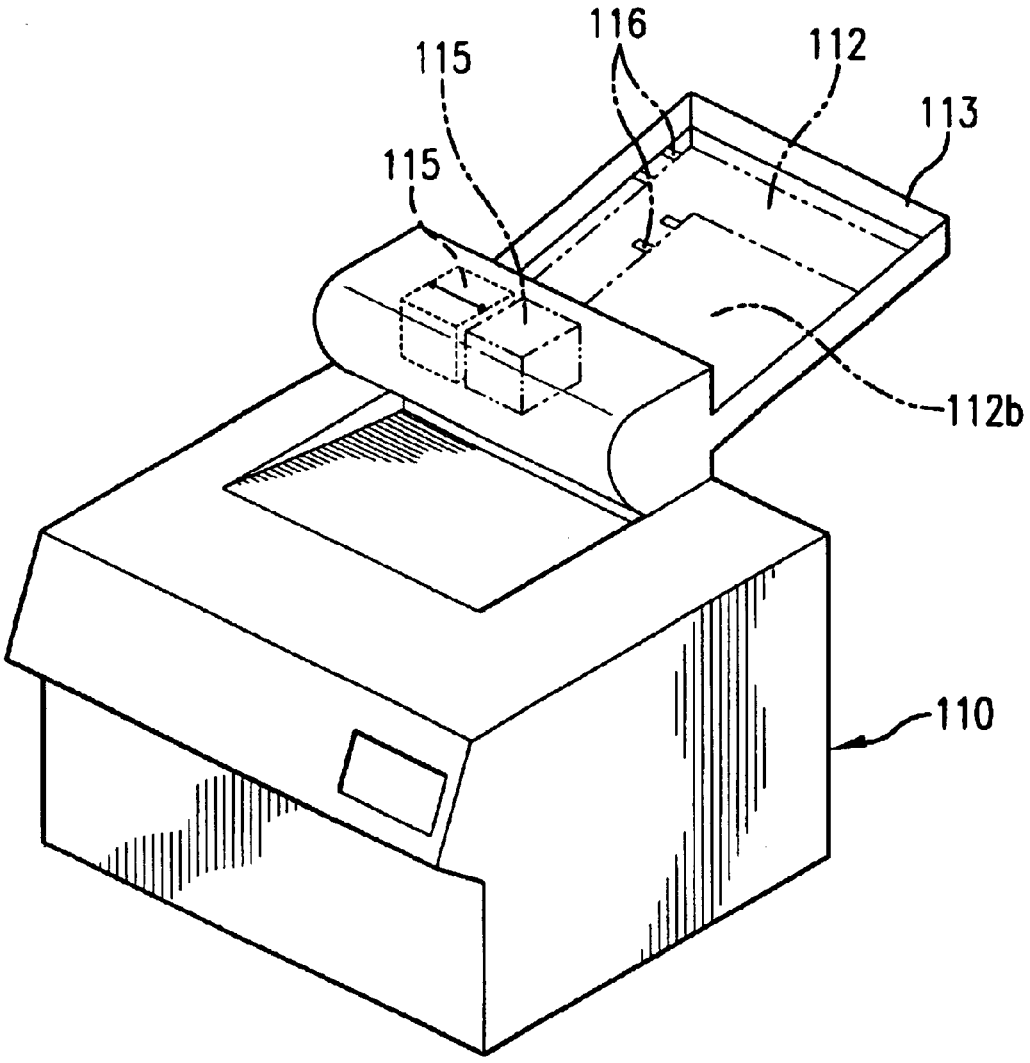
FIG. 35 is the tenth embodiment of a sheet sorting apparatus of the invention.

In particular, FIG. 34 shows the ninth embodiment of the sheet sorting apparatus, and FIG. 35 shows the tenth embodiment of the sheet sorting apparatus of this invention. In these embodiments, the sheet sorting apparatus body 150 and 115, respectively, are movable perpendicular to the sheet feeding direction. This movement may be carried out either manually or automatically by the screw bolt as shown in FIG. 33. Due to these structures, the size of the sheets may be different. Referring to the structure shown in FIG. 34, this structure allows the markers to be attached to the front edge of the sheets.

Referring now to the structure as shown in FIG. 35, if one edge of the sheets 112 are in line on one side of the feeder, then the marker adhering position differs by the sheet size. In this case, by moving the position of the sheet sorting apparatus body 115, a marker can be adhered to the appropriate position on each sheet 112*a* and 112*b*.

Figure 36A:
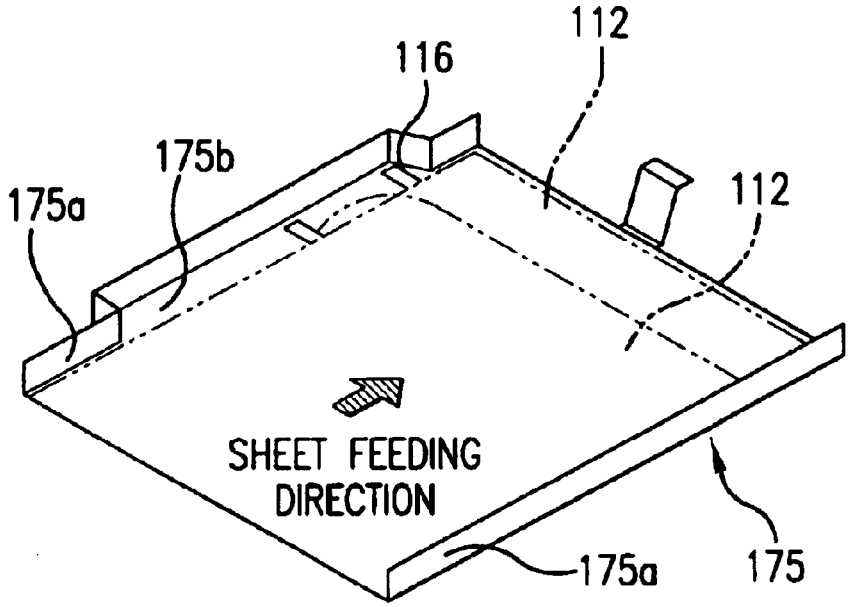
FIG. 36 is the eleventh embodiment of a sheet sorting apparatus of the invention.
Figure 36B:
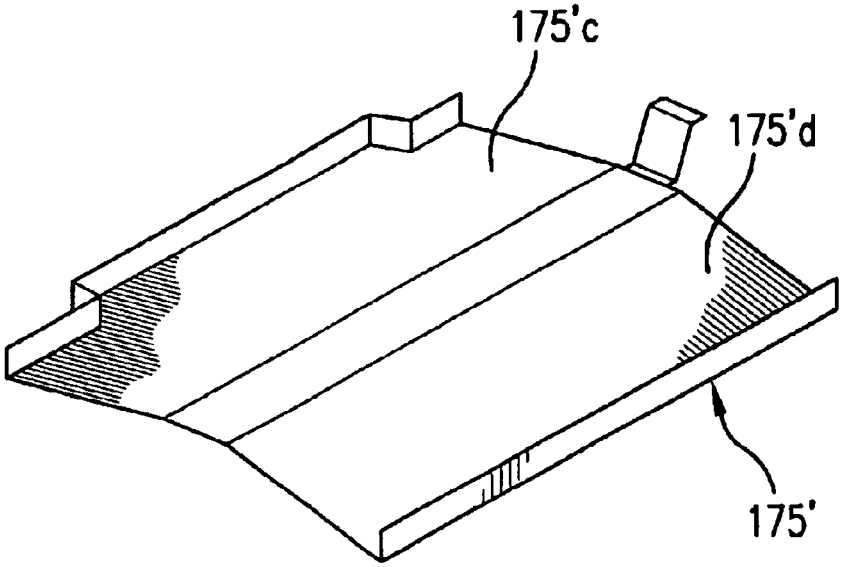

The eleventh embodiment of the sheet sorting apparatus of the invention is shown in FIG. 36. This embodiment illustrates some possible variations of the sheet receiving tray 175. This type of tray 175 is designed to hold sheets 112 with markers 116 affixed to the side edge relative to the sheet feeding direction. As shown in FIG. 36(*a*), both side edges of the tray have walls 175*a* for guiding the sheets 112. An expanded area 175*b* is provided to prevent the markers 116 from contacting the side edge. FIG. 36(*b*) shows an embodiment with tray sides 175'*c* and 175'*d* that ramp downward from the center of the tray 175'. The downward ramps 175'*c* and 175'*d* cause the sheets to be held more securely and prevent the top-piled sheet from sliding off of the tray. Because the sides of the sheets in the tray slope downward, the side edges of a sheet being output will not contact the sheets in the tray 175'. This prevents markers attached to the sheet edges from being accidentally removed by an exiting sheet.

Figure 37:
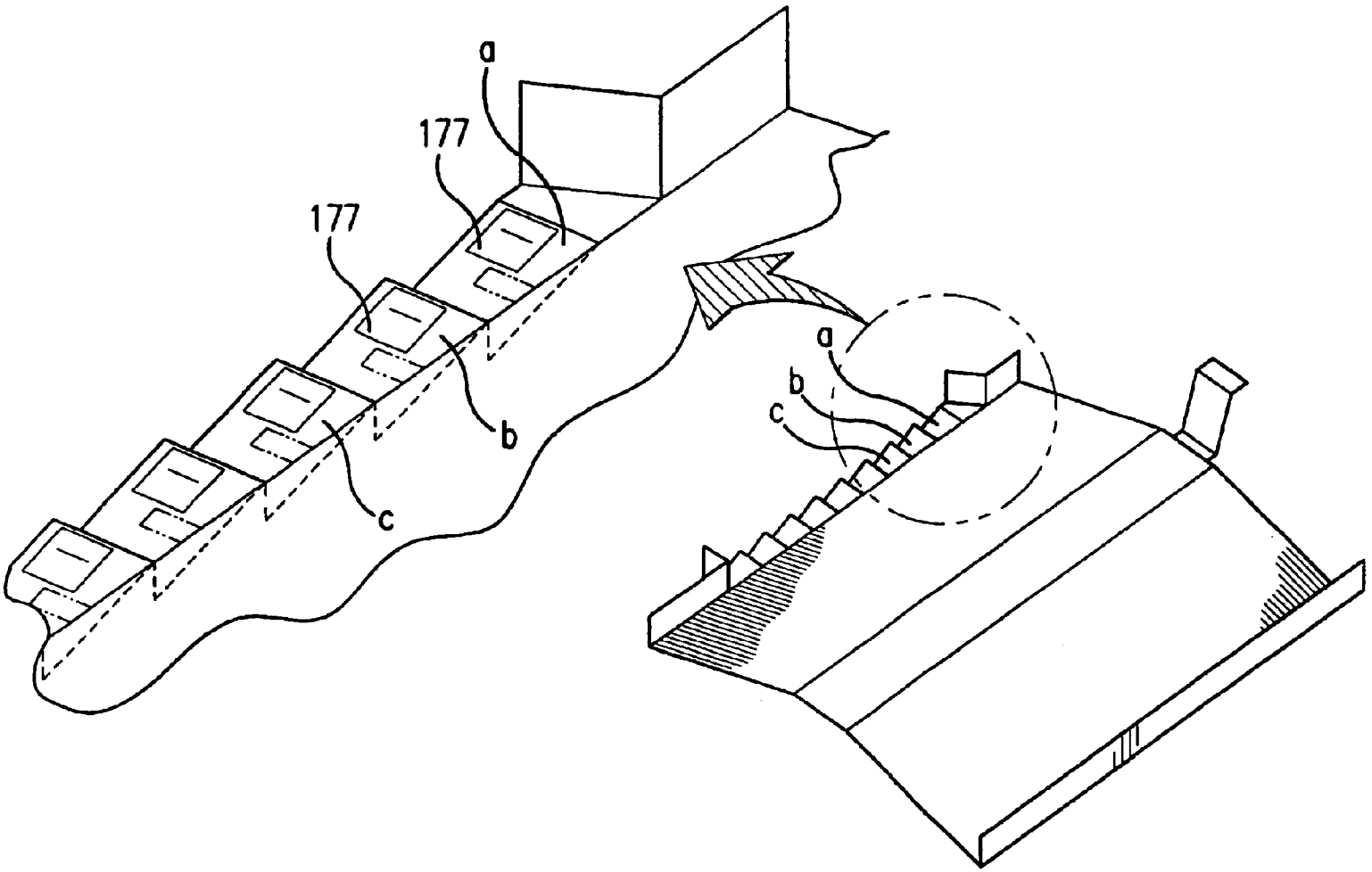
FIGS. 37–38 are the twelfth embodiment of a sheet sorting apparatus of the invention.

FIG. 37 shows the twelfth embodiment of the sheet sorting apparatus of this invention. In this embodiment, the expanded portion of the tray is divided into several sections a, b, c. A label 177 may be attached to each section. The position of a marker on a sheet corresponds to one of the sections on the tray. The marker 116 does not cover the label 177, so the label is visible and may be easily verified by the operator of the apparatus. This structure allows the label 177 to be used as an index, so that exited and piled sheets can be easily distinguished. Many styles for grouping the sheets may be employed according to necessity. For example, sheets can be sorted by each group of documents that are output, by the type of document such as printer or facsimile documents, or by a user-specified method.

Figure 38:
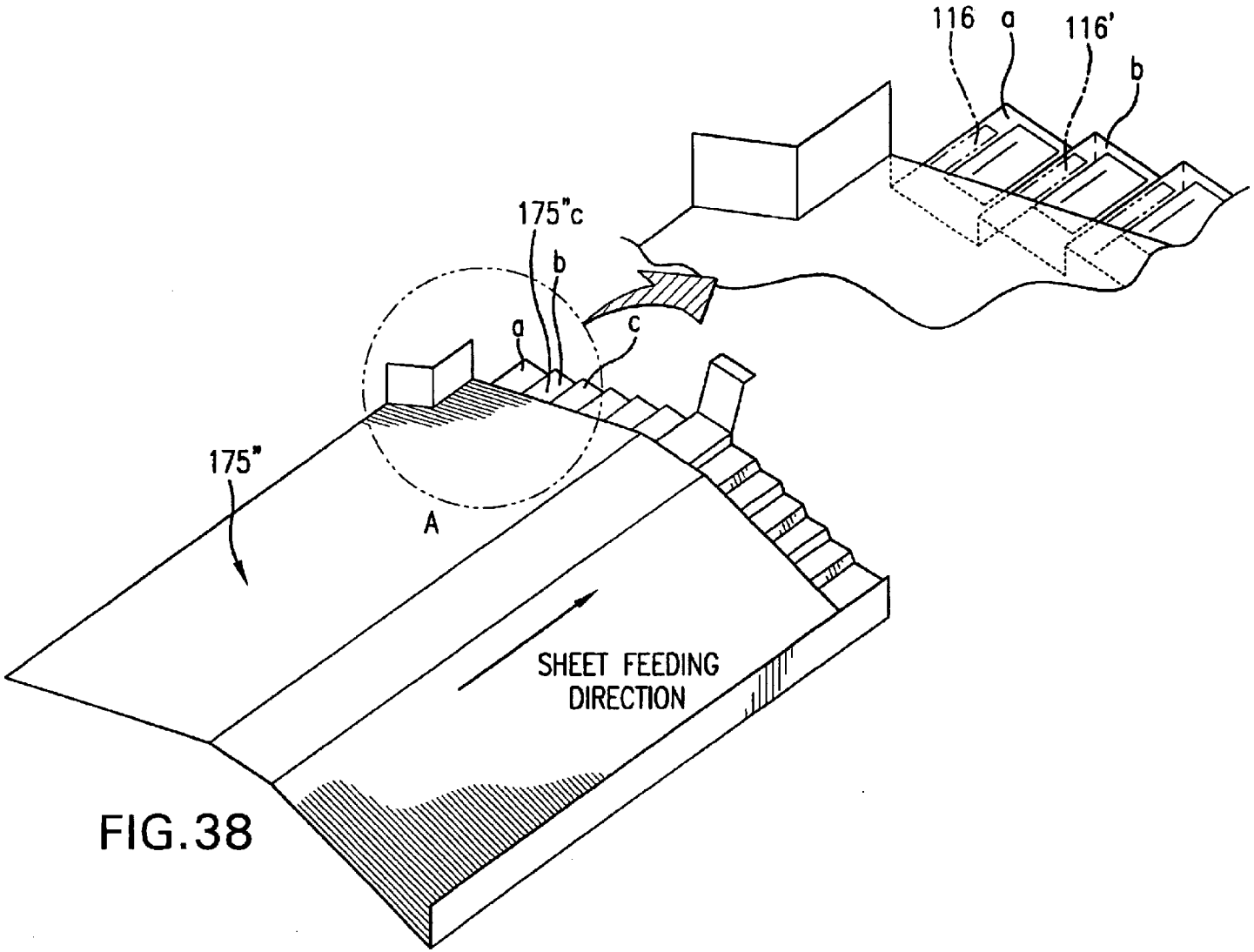

In the embodiment above, the tray can also be flat. The sectioned portion a, b, c may alternately be applied to the forward end of the tray, as shown in FIG. 38. In this case, markers 116 are attached to the front edge of the sheets.

Figure 39:
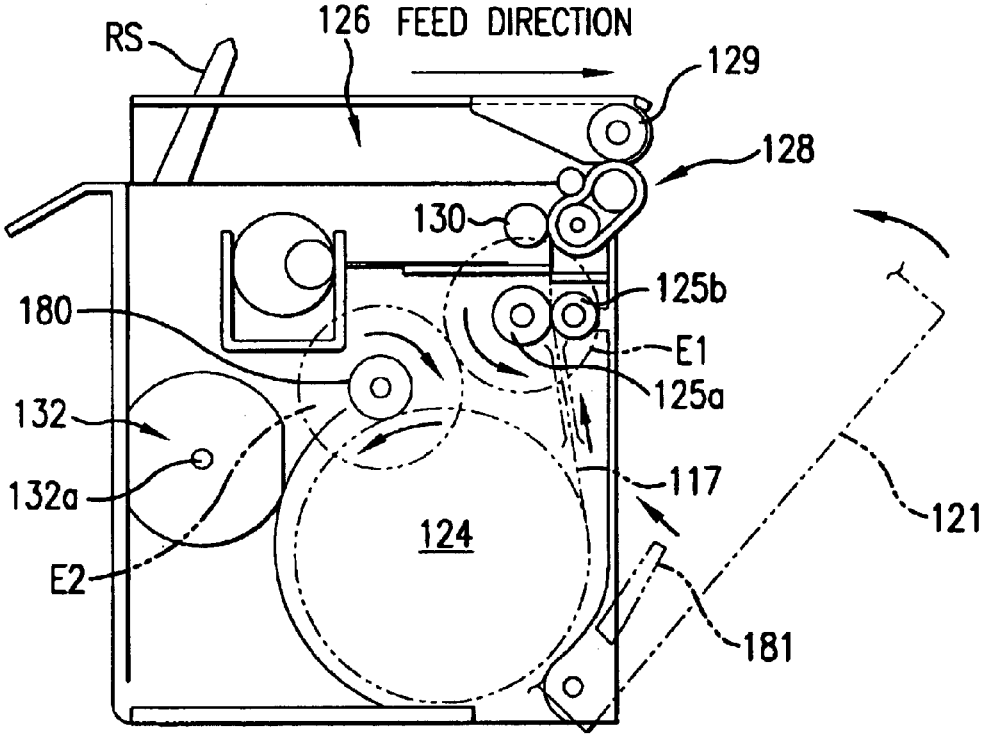
FIGS. 39–40 are the thirteenth embodiment of a sheet sorting apparatus of the invention.
Figure 40:
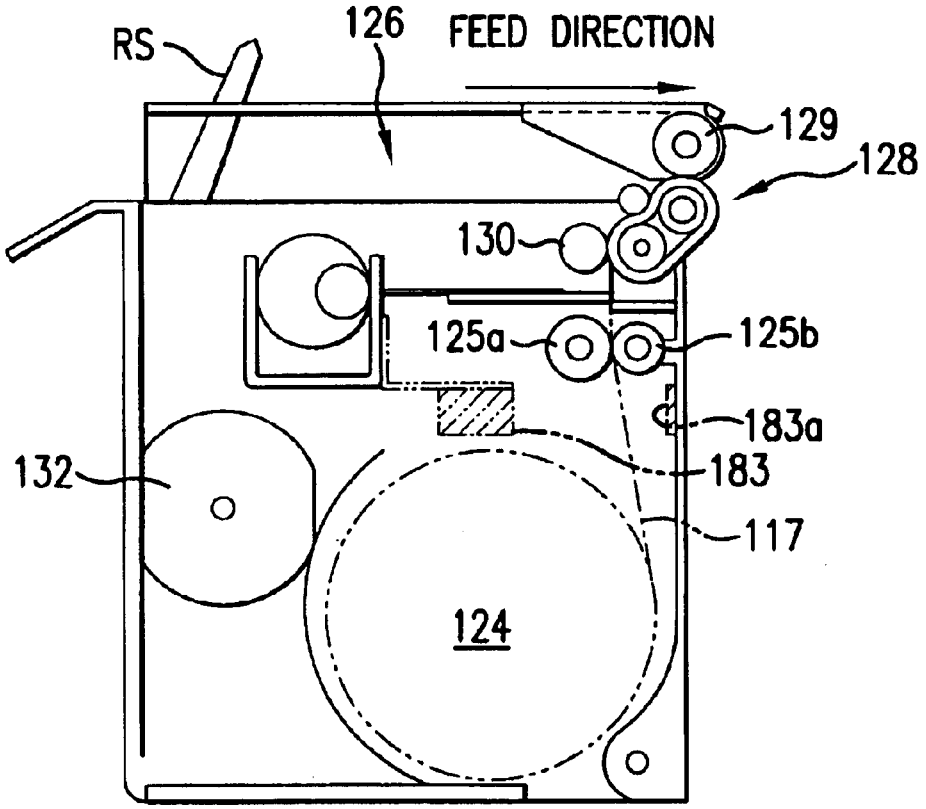

FIGS. 39 and 40 show the thirteenth embodiment of the sheet sorting apparatus of this invention, a function of automatically loading a tape roll 124 for the sheet sorting apparatus based on the embodiments. After exchanging the roll 124 and closing the cover 121, the tape 117 is automatically pulled out from the roll 124 and stops at a certain position ready for the adhering operation. A gear E1 is provided on the shaft of the pull-out roller 125*a*. A feed roller 180 is provided on the shaft of a gear E2 engaging gear E1. Gears E1 and E2 do not interfere with the operation of the other gears A, B, C, or D. The feed roller 180 contacts the tape roll 124. The feed roller 180 and the pull-out roller 125*a* are interconnected so that by the rotation of the feed roller, the tape roll 124 is rotated and the tape 117 is pulled out at the same rate. A switch 181 is provided on the cover 121 to detect when the cover is opened. The switch 181 detects when the cover 121 is closed after exchanging the tape roll 124. The detection signal is sent to a controller (not shown). The controller drives the motor 132 based on the detection signal. The motor 132 drives gear C via gears A and B. When C3 is rotated, it causes the pull-out roller 125*a* to rotate. Accordingly, the driving force is transmitted to gears E1 and E2. The feed roller 180 and the tape roll 124 are then rotated, and the tape 117 is pulled out.

The length of the time the drive motor 132 is active may be set to a predetermined time after receiving the detection signal from the cover switch 181. Alternatively, as shown in the embodiment in FIG. 40, a reflective sensor 183 can be provided above the tape roll 124. A reflection plate 183*a* is provided on the cover 121. When the cover 121, is closed after inserting a new tape toll, the reflection sensor 183 detects comparably strong light reflected from the reflection plate 183 because there is no tape between the sensor 183 and the plate 183*a*. When the tape 117 is pulled out, it covers plate 183*a* causing the amount of reflected light to be decreased. This allows the reflection sensor 183 to detect when the top of the tape 117 passes. After a predetermined time, the driving motor 132 is stopped. This structure allows the tape 117 to be loaded automatically by simply closing the cover 121.

FIGS. 36 to 38 show other embodiments of the sheet receiving trays. They are designed to hold sheets with markers affixed to the edges.

FIGS. 39 and 40 show a function of automatically loading a marker roll 124. After exchanging the roll 124 and closing the cover 121, the tape 117 is automatically pulled out from the roll 124 and stops at a certain position ready for the adhering operation.

The primary advantages of this invention are as follows. By adhering markers to predetermined sheets, a group of sheets can be easily distinguished when multiple groups of sheets are piled on a single tray. The groups of sheets are sorted quickly and accurately. Markers are adhered to sheets by pressure-sensitive adhesive, so that the probability of them falling off is reduced. The marker adhering process is operated by a pair of feeding means with the sheet. The sheet being fed is not stopped while the marker is adhered, allowing non-stop operation. Sorting is operated by the marker. The invention is still effective when different-sized sheets are used.

While the invention has been described in detail with reference to a number of embodiments, it should be apparent to those skilled in the art that many modifications and variations are possible without departure from the scope and spirit of this invention as defined in the appended claims.

What is claimed is:

1. A sheet sorting apparatus for adhering a marker to each predetermined sheet of a group of sheets being output by an image processing apparatus, comprising:

a tape feeder for pulling out a tape, whose width is smaller than that of said sheets, having a pressure sensitive adhesive on one side edge;

a cutter for making the marker by cutting the tape at a preset length;

a guide for positioning the marker at a predetermined position on the predetermined sheet; and a marker and sheet feeder for synchronously feeding the marker and the predetermined sheet in a partially overlapping position, wherein the marker and sheet feeder are formed as a pair of feeding means for positioning in contact with each other when the marker is adhered to the predetermined sheet, and separate from each other when sheets not receiving a marker are fed, and the marker is adhered to the predetermined sheet by a predetermined pressure force as the predetermined sheet passes through the marker and sheet feeder without pausing the marker and sheet feeder, with one portion of the marker overlapping and in contact with the predetermined sheet and remainder of the marker protruding from the predetermined sheet to indicate a boundary between a sheet or group of sheets and a subsequent sheet or group of sheets.

2. The sheet sorting apparatus according to claim 1, wherein said marker is adhered to the under side of the sheet.

3. The sheet sorting apparatus according to claim 1 or 2, further comprising:

a character mark printer for applying a predetermined color pattern or character to the marker; and a printer controller for determining the character or pattern to print on the marker, so that the same character or pattern is printed on each said marker in a group of said sheets.

4. The sheet sorting apparatus according to claim 1, further comprising means for changing the adhering position of the marker on the sheet.

5. The sheet sorting apparatus according to claim 1, further comprising a marker detector in a forward position of the sheet sorting apparatus.

6. The sheet sorting apparatus according to claim 1, further comprising a tape end detector on the path of the tape for signaling an exchange of the tape.

7. The sheet sorting apparatus according to claim 1, further comprising a single motor for driving the tape feeder, the cutter, the guide and the marker and sheet feeder.

8. The sheet sorting apparatus according to claim 1, wherein the tape feeder, the cutter, the guide and the marker and sheet feeder are driven by an external motor.

9. The sheet sorting apparatus according to claim 3, wherein the character mark printer is an inkjet printer for applying the predetermined color pattern to the marker.

10. The sheet sorting apparatus according to claim 3, wherein the character mark printer is a stamper for applying the predetermined character to the marker.

11. An image processing apparatus comprising a sheet sorting apparatus for adhering a marker to each predetermined sheet of a group of sheets discharged from the image processing apparatus, the sheet sorting apparatus comprising:

a tape feeder for pulling out a tape, whose width is smaller than that of said sheets, having a pressure sensitive adhesive on one side edge;

a guide for positioning the marker at a predetermined position on the predetermined sheet; and a marker and sheet feeder for synchronously feeding the marker and the predetermined sheet in a partially overlapping position, wherein the marker and sheet feeder are formed as a pair of feeding means for positioning in contact with each other when the marker is adhered to the predetermined sheet and separate from each other when sheets not receiving a marker are fed, and the marker is adhered to the predetermined sheet by a predetermined pressure force as the predetermined sheet passes through the marker and sheet feeder without pausing the marker and sheet feeder, with one portion of the marker overlapping and in contact with the predetermined sheet and the remainder of the marker protruding from the predetermined sheet to indicate a boundary between a sheet or group of sheets and a subsequent sheet or group of sheets.

12. The image processing apparatus according to claim 11, further comprising a tray for receiving sheets being output by the image processing apparatus, wherein at least one side of the tray is lower than the middle part of the tray.

13. A sheet sorting apparatus according to claim 1, wherein the exchange of the position of the feeding means is operated synchronously with the operation of the cutter.

* * * * *